US010941656B2

(12) United States Patent
Garcia et al.

(10) Patent No.: US 10,941,656 B2
(45) Date of Patent: Mar. 9, 2021

(54) DOWNHOLE CONFIGURABLE TESTING APPARATUS AND METHODS

(71) Applicant: Schlumberger Technology Corporation, Sugar Land, TX (US)

(72) Inventors: German Garcia, Katy, TX (US); Hadrien Dumont, Houston, TX (US); Christopher Albert Babin, Waveland, MS (US); Li Chen, Katy, TX (US); Vinay K. Mishra, Katy, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 251 days.

(21) Appl. No.: 15/887,049

(22) Filed: Feb. 2, 2018

(65) Prior Publication Data

US 2018/0216458 A1 Aug. 2, 2018

Related U.S. Application Data

(60) Provisional application No. 62/453,621, filed on Feb. 2, 2017.

(51) Int. Cl.

| | |
|---|---|
| ***E21B 49/10*** | (2006.01) |
| ***E21B 23/01*** | (2006.01) |
| ***E21B 47/06*** | (2012.01) |
| ***E21B 49/06*** | (2006.01) |

(52) U.S. Cl.
CPC ..... *E21B 49/10* (2013.01); *E21B 23/01* (2013.01); *E21B 47/06* (2013.01); *E21B 49/06* (2013.01)

(58) Field of Classification Search
CPC .... E21B 49/00–10; E21B 23/01; E21B 23/14; E21B 47/06; E21B 47/01; E21B 47/04; E21B 47/065; E21B 47/013
See application file for complete search history.

(56) References Cited

U.S. PATENT DOCUMENTS

| | | | | |
|---|---|---|---|---|
| 4,898,240 A * | 2/1990 | Wittrisch | ..... | E21B 23/08 166/250.17 |
| 5,301,759 A * | 4/1994 | Ruhle | ..... | E21B 4/04 175/246 |
| 2009/0025941 A1* | 1/2009 | Iskander | ..... | E21B 23/14 166/381 |

* cited by examiner

*Primary Examiner* — George S Gray
(74) *Attorney, Agent, or Firm* — Trevor G. Grove

(57) ABSTRACT

Apparatus and methods for performing downhole testing. Example apparatus include a downhole tool string for conveying within a wellbore, the downhole tool string comprising an anchor device, a testing device, and a linear or rotary actuator. The anchor device maintains a portion of the downhole tool string in a predetermined position within the wellbore. The testing device is operable to receive a downhole sample from or test a subterranean formation surrounding the wellbore. The linear actuator is connected between the anchor device and testing device, and moves the testing device relative to the anchor device.

19 Claims, 9 Drawing Sheets

DOWNHOLE CONFIGURABLE TESTING APPARATUS AND METHODS

CROSS-REFERENCE TO RELATED APPLICATIONS

The present application claims priority to, and the benefit of, U.S. Provisional Patent Application No. 62/453,621, titled "Increased Efficiency in Downhole Testing," filed Feb. 2, 2017, the entire disclosure of which is hereby incorporated herein by reference.

BACKGROUND OF THE DISCLOSURE

Wells are generally drilled into the ground or ocean bed to recover natural deposits of oil and gas, as well as other desirable materials that are trapped in geological formations in the Earth's crust. Such wells are drilled using a drill bit attached to the lower end of a drill string. Drilling fluid is pumped from the wellsite surface down through the drill string to the drill bit. The drilling fluid lubricates and cools the bit and carries drill cuttings back to the surface.

In some oil and gas exploration operations, it may be beneficial to have information about the subsurface rock formations that are penetrated by the wellbore. For example, certain formation testing schemes include measurement and analysis of formation pressure, formation fluid, and rock formation itself. Such tests may include extracting a sample of the formation fluid from the formation, cutting a sample of the rock formation, and analyzing and/or testing the samples. These tests may be useful for predicting the production capacity and lifetime of the subsurface formation.

A single well survey may include a hundred or more different depths or "stations" at which the formation may be tested. Moreover, a substantial number of the tests performed (e.g., about 40%) may fail and thus be repeated at nearby wellbore depths (e.g., within about thirty centimeters), such that the number of actual test stations is even larger than initially planned.

A wireline or other conveyance means is utilized to move the testing tool string to the different depths within the wellbore at which testing is to be performed. However, each such longitudinal shift consumes valuable rig and personnel time, especially when repeated two, three, or more times to ensure accurate depth positioning. Such shifting operations may also generate depth offsets, and periodic depth correlation passes may be utilized to correct the offsets, again consuming valuable time. The shifting operations also add cycles to the wireline and/or other conveyance means, which can result in substantial delays (for replacements/repairs) and other inefficiencies in the performance of the well survey (e.g., depth positioning inaccuracies).

SUMMARY OF THE DISCLOSURE

This summary is provided to introduce a selection of concepts that are further described below in the detailed description. This summary is not intended to identify indispensable features of the claimed subject matter, nor is it intended for use as an aid in limiting the scope of the claimed subject matter.

The present disclosure introduces an apparatus including a downhole tool string for conveying within a wellbore. The downhole tool string includes an anchor device, a testing device, and a linear actuator. The anchor device is operable to maintain at least a portion of the downhole tool string in a predetermined position within the wellbore. The testing device is operable to receive a downhole sample. The linear actuator is connected between the anchor device and testing device and is operable to move the testing device along the wellbore with respect to the anchor device.

The present disclosure also introduces a method including conveying a downhole tool string within a wellbore from a wellsite surface. The downhole tool string includes an anchor device, an linear actuator, and a testing device. The method includes engaging the anchor device with a sidewall of the wellbore to maintain at least a portion of the downhole tool string in a predetermined position within the wellbore. The linear actuator is operated to move the testing device a distance longitudinally along the wellbore. The testing device is operated to receive a downhole sample.

The present disclosure also introduces a method including operating a conveyance device at a wellsite surface to convey a downhole tool string within a wellbore. The downhole tool string includes a moving device and a testing device. The method also includes engaging a sidewall of the wellbore to maintain at least a portion of the downhole tool string fixed within the wellbore. The moving device is operated to move the testing device longitudinally to a position along the wellbore. The testing device is operated to engage a portion of the testing device with the sidewall at the position along the wellbore.

The present disclosure also introduces a method including conveying a downhole tool string within a wellbore from a wellsite surface. The downhole tool string includes an anchor device, a linear actuator and/or a rotary actuator, and a testing device. The anchor device is engaged with a sidewall of the wellbore to maintain at least a portion of the downhole tool string in a predetermined position within the wellbore. The linear actuator and/or the rotary actuator is operated to longitudinally and/or azimuthally move the testing device to an intended position relative to the wellbore. A fluid testing, pressure testing, or coring operation is performed utilizing the testing device at the intended position.

These and additional aspects of the present disclosure are set forth in the description that follows, and/or may be learned by a person having ordinary skill in the art by reading the materials herein and/or practicing the principles described herein. At least some aspects of the present disclosure may be achieved via means recited in the attached claims.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
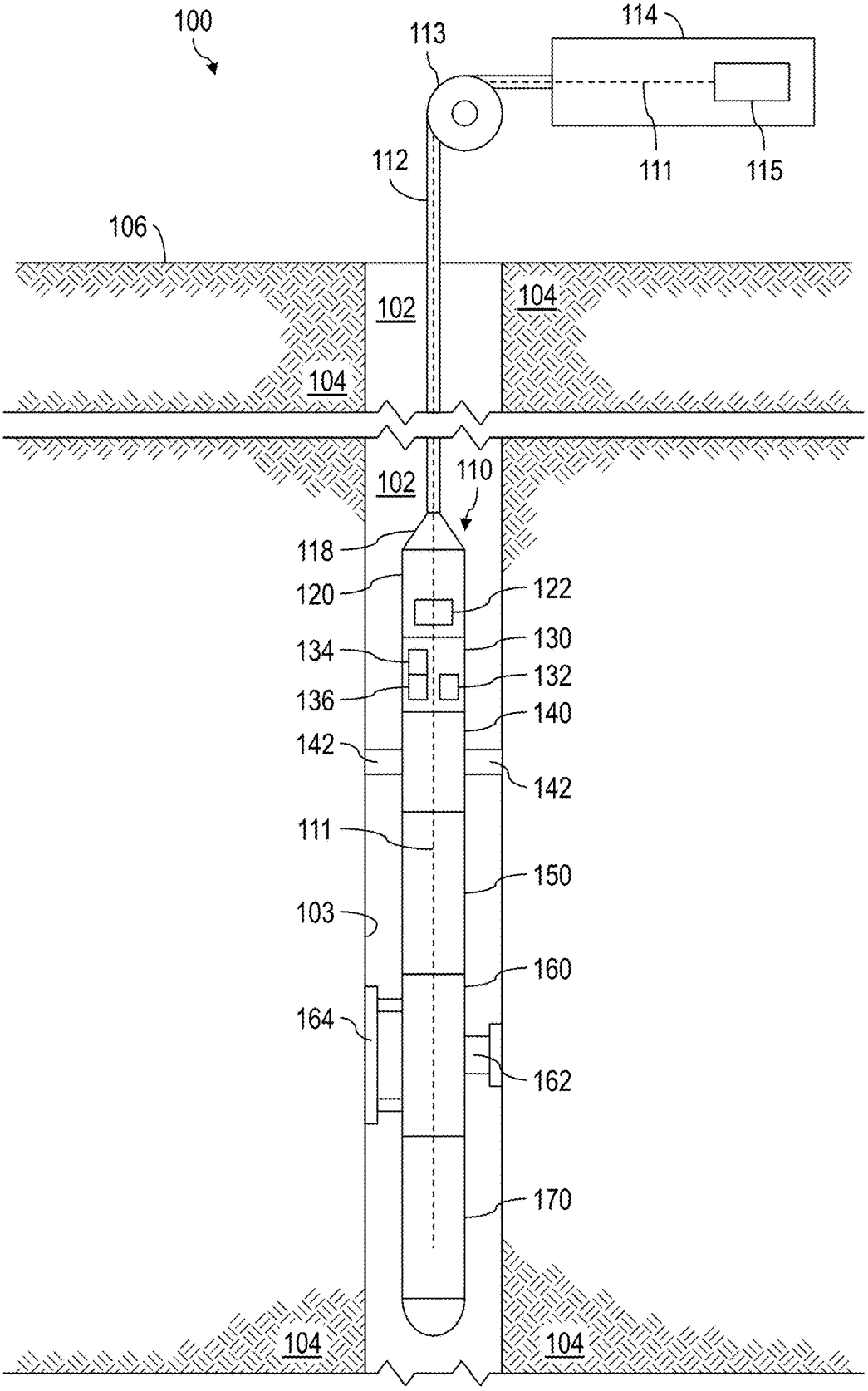
FIG. 1 is a schematic view of at least a portion of an example implementation of apparatus according to one or more aspects of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for simplicity and clarity, and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

FIG. 1 is a schematic view of at least a portion of an example implementation of a wellsite system 100 to which one or more aspects of the present disclosure may be applicable. The wellsite system 100, which may be situated onshore or offshore, comprises a downhole tool string 110 operable for engaging a sidewall 103 of a wellbore 102 that extends into a subterranean formation 104. The tool string 110 is suspended in the wellbore 102 by a conveyance means 112, such as a wireline, a slickline, an e-line, coiled tubing, production tubing, and/or other conveyance means, operably coupled with a tensioning device 113 disposed at a wellsite surface 106. The tensioning device 113 may be, comprise, or form at least a portion of a crane, a winch, a drawworks, a top drive, and/or another device operable in conjunction with the conveyance means 112 to convey the tool string 110 within the wellbore 102.

A single- or multi-conductor cable, hereinafter referred to as a conductor 111, may extend through the conveyance means 112 and at least partially within the tool string 110 and surface equipment 114. The conductor 111 may facilitate electrical and/or optical communication between one or more components of the surface equipment 114, including an uphole controller or processing system 115 and one or more portions of the tool string 110, including a downhole controller or processing system 122. The conductor 111 may permit electrical power transfer to the tool string 110, and/or electrical and/or optical signal communication between the surface equipment 114 and the tool string 110. The uphole processing system 115 may comprise an interface for receiving commands from a human operator, and may be operable to store programs or instructions, including for implementing one or more aspects of the methods described herein.

The tool string 110 may be or comprise one or more downhole tools, subs, modules, and/or other apparatuses operable in wireline, coiled tubing, completion, production, and/or other operations. For example, the tool string 110 may comprise one or more of a cable head 118, a telemetry module 120, a power module 130, an anchor module 140, a moving module 150, a testing module 160, and a sample containment module 170. Although not shown, the tool string 110 may also comprise additional components or modules at various locations along the tool string 110, each of which may perform various functions while performing downhole operations within the scope of the present disclosure. For example, the tool string 110 may further comprise one or more of an acoustic tool, a coring (inline or sidewall) tool, a cutting tool, a density tool, a directional tool, a downhole tractor, an electromagnetic (EM) tool, an engagement tool, a fishing tool, a fluid sampling tool, a formation evaluation tool, a formation logging tool, a formation pressure testing tool, a gamma ray tool, a gravity tool, an imaging tool, an impact tool, an impulse tool, an inclination tool, a jarring tool, a magnetic resonance tool, a mechanical interface tool, a monitoring tool, a neutron tool, a nuclear tool, a perforating tool, a photoelectric factor tool, a plug setting tool, a porosity tool, a release tool, a reservoir characterization tool, a resistivity tool, a rotary positioning tool, a seismic tool, a sonic tool, a stroker tool, a surveying tool, a ultrasonic tool, and/or a valve key, among other examples.

Each of the telemetry module 120, the power module 130, the anchor module 140, the moving module 150, the testing module 160, and the sample containment module 170 may convey or comprise a portion of the conductor 111 extending through the tool string 110. The conductor 111 may include various electrical and/or optical connectors or interfaces (not shown), such as may facilitate connection between the conductor 111 and one or more of the modules 120, 130, 140, 150, 160, 170 to permit communication between one or more of the modules 120, 130, 140, 150, 160, 170 and one or more components of the surface equipment 114, including the processing system 115. For example, the conductor 111 may be operable to transfer electrical power, data, and/or control signals between the surface equipment 114 and one or more of the modules 120, 130, 140, 150, 160, 170.

The cable head 118 may be operable to connect the conveyance means 112 with the tool string 110. The telemetry module 120 may facilitate positioning of the tool string 110 along the wellbore 102, communication with the surface equipment 114, and/or other operations of the tool string 110. The telemetry module 120 may comprise the downhole processing system 122 communicatively coupled to the surface equipment 114, including the uphole processing system 115, via the conductor 111. The downhole processing system 122 may comprise a circuit board and/or various electronic components for controlling operational aspects of the tool string 110, and may have an interface for receiving commands from the human operator. The downhole processing system 122 may also store programs or instructions, including for implementing one or more aspects of the methods described herein. For example, the uphole and/or the downhole processing systems 115, 122 may operate independently or cooperatively to control one or more portions of the modules 120, 130, 140, 150, 160, 170. The uphole and/or downhole processing systems 115, 122 may also analyze and/or process data obtained from various sensors disposed within or making up the modules 120, 130, 140, 150, 160, 170, store measurements and/or processed data, and/or communicate the measurements and/or processed data to the surface equipment 114 for subsequent analysis.

The power module 130 may be or comprise an electrical power source 132 and/or a hydraulic power source. The hydraulic power source may comprise a hydraulic fluid containment chamber 134 and a hydraulic fluid pump 136, such as may be operable to selectively power and/or actuate one or more components of the tool string 110, such as one or more components of the anchor module 140, the moving module 150, and/or the testing module 160, among other examples.

The anchor module 140 may be operable to engage the sidewall 103 of the wellbore 102 to maintain at least a portion of the tool string 110 substantially fixed at a predetermined position relative to the wellbore 102. The anchor module 140 may comprise gripping members 142 located on opposing sides of the anchor module 140. The gripping members 142 may be operable to selectively extend outward against the sidewall 103 to hold or anchor at least a portion of the tool string 110 in a substantially fixed position relative the wellbore 102. Although FIG. 1 shows the anchor module 140 comprising two gripping members 142, other implementations of the anchor module 140 within the scope of the present disclosure may include three, four, or more gripping members 142.

The moving module 150 may be or comprise a linear actuator operable to move at least a portion of the tool string 110 longitudinally relative to the wellbore 102. The moving module 150 may be coupled within the tool string 110 between the anchor module 140 and the testing module 160. The moving module 150 may be or comprise a ram or a stroker tool, such as may be operable to move the testing module 160 with respect to the anchor module 140 when the gripping members 142 of the anchor module 140 are engaged with the sidewall 103 of the wellbore 102.

The moving module 150 may instead be or comprise a downhole tractor 610 (shown in FIG. 10) utilizing rotating drives to move the tool string 110, including the testing module 160, longitudinally within the wellbore 102. The moving module 150 may instead be or comprise a downhole tractor 710 (shown in FIG. 11) utilizing an inchworm principle with two or more sections alternatingly gripping the sidewall 103 and resetting to move the tool string 110 longitudinally within the wellbore 120. The anchor module 140 may be omitted if the tractor 610, 710 is utilized instead of the stroker tool. However, in some operations, tractors utilizing rotating drives may be susceptible to slippage between the rotating drives and the sidewall 103, thus reducing the ability to precisely move and position the tool string 110 and the testing module 160 within the wellbore 102. Accordingly, when the tractor 610 is utilized, the tool string 110 may also include a linear actuator module 250 (shown in FIGS. 2 and 3), such as a ram or a stroker tool, which may be operated to move and position the testing module 160 within the wellbore 102 when the tractor 610 is fixed in position against the sidewall 103.

The testing module 160 may be or comprise a device operable to collect a downhole sample, and/or to test one or more properties of the downhole environment, including properties of a downhole fluid or rock formation. Examples of such measured properties may include composition, density, porosity, pressure, temperature, and viscosity, among others. The testing module 160 may be operable to extract, receive, or otherwise collect downhole samples, including wellbore fluid samples, rock formation samples, and/or formation fluid samples. The testing module 160 may comprise a sample retrieving portion 162, such as a probe, packer, and/or bit that is selectively extendable or otherwise outwardly movable to engage the sidewall 103 of the wellbore 102 to extract a fluid (liquid and/or gas) and/or core sample from the formation 102. The testing module 160 may further comprise a selectively extendable or otherwise outwardly movable anchoring member 164 located radially opposite the sample retrieving portion 162 for maintaining the testing module 160 in position within the wellbore 102.

The sample containment module 170 may be operable to receive the downhole sample from the testing module 160 and store the downhole sample to be analyzed downhole and/or to be retrieved to the wellsite surface 106 for further analysis. For example, the sample containment module 170 may comprise one or more detachable containers (not shown) disposed or installed within the sample containment module 170. The detachable containers may receive and retain therein the captured sample for subsequent testing at the surface 106.

Figure 2:
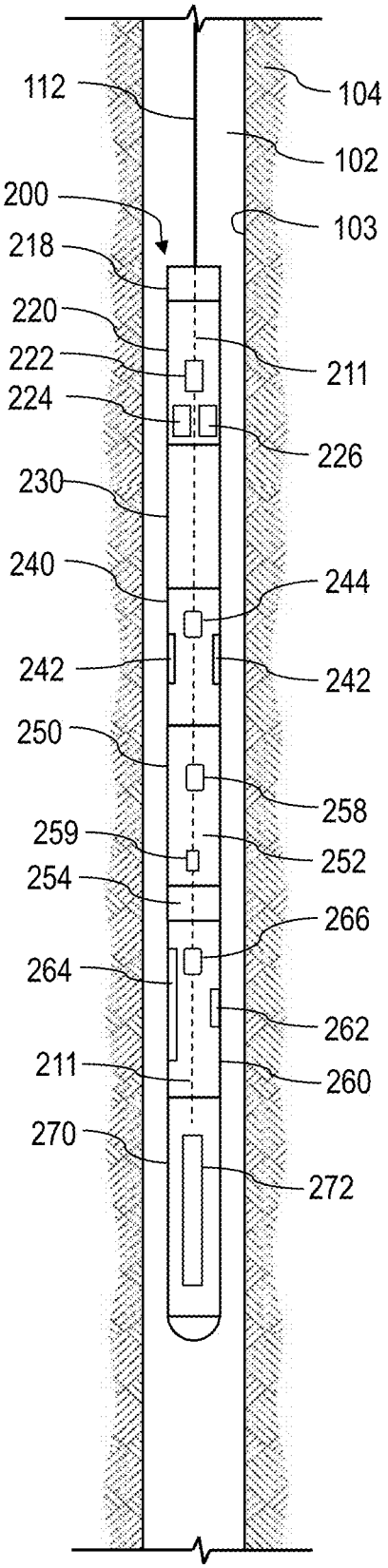
FIG. 2 is a schematic view of at least a portion of an example implementation of apparatus according to one or more aspects of the present disclosure.
Figure 3:
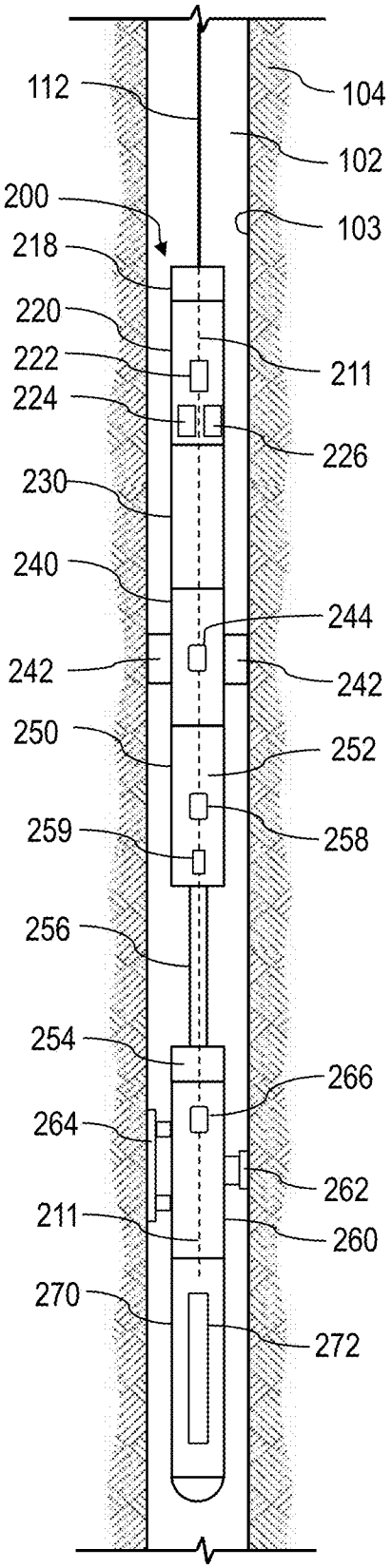
FIG. 3 is a schematic view of the apparatus shown in FIG. 2 at a different stage of operation.

FIGS. 2 and 3 are schematic views of an example implementation of a tool string 200 in different stages of operation according to one or more aspects of the present disclosure. The tool string 200 may be an example implementation of, and/or otherwise comprises one or more features similar to, the tool string 100 shown in FIG. 1, except perhaps as described below. The tool string 200 is shown comprising a conductor 211, a cable head 218, a telemetry module 220, a power module 230, an anchor module 240, a linear actuator module 250, a testing module 260, and a sample module 270, which may be substantially similar to the conductor 111, the cable head 118, the telemetry module 120, the power module 130, the anchor module 140, the moving module 150, the testing module 160, and the sample containment module 170, respectively, except perhaps as described below. The tool string 200 is shown disposed within a vertical portion of the wellbore 102 and connected with the surface equipment 114 (not shown in FIGS. 2 and 3) via the conveyance means 112. However, the tool string 200 may also be utilized within a substantially horizontal or otherwise deviated portion of the wellbore 102. The following description refers to FIGS. 1-3, collectively.

The various modules of the tool string 200 may be communicatively connected with the wellsite equipment 114 via the conductor 211 extending along the modules of the tool string 200. Although not shown, the tool string 200 may comprise one or more bores and/or other passages extending longitudinally through the modules of the tool string 200 to accommodate the conductor 211.

The telemetry module 220 may comprise a processing system 222 communicatively coupled with one or more modules of the tool string 200 and with the surface equipment 114 via the conductor 211. The processing systems 115, 222 may independently or cooperatively control operations of the modules and other components of the tool string 200. For example, the processing system 222 may be operable to receive and process signals obtained from various sensors of the tool string 200, store the processed signals, operate the modules of the tool string 200 based on the processed signals, and/or communicate the processed signals to the processing system 115 and/or another component of the surface equipment 114. The processing system 222 may also be operable to receive control commands from the processing system 115 for controlling the modules and other components of the tool string 200.

The telemetry module 220 (and/or another portion of the tool string 200) may also comprise one or more correlation tools. For example, the telemetry module 220 may comprise a gamma ray tool 224 operable for recording naturally occurring gamma rays in the formation 104. The nuclear measurements may indicate the radioactive contents/locations of the formation 104, and may thus be utilized for correlation of various other logs obtained with the tool string 200 and/or other tool strings. Examples of the gamma ray tool 224, and/or the telemetry module 220 having gamma ray functionality, may include Schlumberger's Highly Integrated Gamma Neutron Sonde (HGNS), Hostile Environment Telemetry and Gamma Ray Cartridge (HTGC), Scintillation Gamma Ray Tool (SGT), Slim Telemetry and Gamma Ray Cartridge (STGC), SlimXtreme Telemetry and Gamma Ray Cartridge (QTGC), and Combinable Gamma Ray Sonde (CGRS), among other current and/or future-developed industry offerings.

The telemetry module 220 (and/or another portion of the tool string 200) may also comprise one or more inclination tools operable for providing inclinometer measurements. For example, the telemetry module 220 may comprise an inclination tool 226 operable for measuring tool deviation, tool azimuth, and/or relative bearing. The inclination tool 226 may utilize an inclinometer (e.g., three-axis) and/or a magnetometer (e.g., three-axis) to make measurements for determining such parameters. An example of the inclination tool 226 may be Schlumberger's General-Purpose Inclinometry Tool (GPIT), among other current and/or future-developed industry offerings.

The tool string 200 may further comprise the anchor module 240 operable to selectively engage the sidewall 103 of the wellbore 102 to maintain at least a portion of the tool string 200 in a substantially fixed position along the wellbore 102. For example, the anchor module 240 may comprise gripping members 242 located on opposing sides of the anchor module 240. As shown in FIG. 2, during downhole conveyance of the tool string 110, the gripping members 242 may be retracted into the body of the anchor module 240. When the tool string 110 reaches an intended position along the wellbore 102, the gripping members 242 may be operated to extend outward against the sidewall 103, as shown in FIG. 3, to lock or maintain at least a portion of the tool string 200 substantially fixed in position relative to the wellbore 102. The anchor module 240 may comprise one or more actuators 244 operable to extend and retract the gripping members 242 into and from engagement with the sidewall 103. The actuator 244 may be implemented as a hydraulic ram or motor, an electric linear actuator or motor, and/or another actuator.

The linear actuator module 250 may be or comprise a linear actuator, such as a ram or stroker tool, operable to move a portion of the tool string 200 longitudinally along the wellbore 102. The actuator module 250 may comprise a static portion 252 directly or indirectly connected with the anchor module 240, and a movable portion 254 directly or indirectly connected with the testing module 260. The static portion 252 may be connected with the movable portion 254 via an intermediate shaft 256. The shaft 256 may be movably connected with the static portion 252 and fixedly connected with the movable portion 254. During downhole conveyance or prior to testing operations, the linear actuator 250 may be in a retracted state, as shown in FIG. 2. When the gripping members 242 of the anchor module 240 engage the sidewall 103 of the wellbore 102, the linear actuator 250 may be operated to extend the shaft 256 from the static portion 252 to move the movable portion 254 and the formation testing module 260 in the downhole direction with respect to the anchor module 240 and the static portion 252 of the linear actuator module 250, as shown in FIG. 3. The actuator module 250 may comprise a stroke length ranging between about 50 centimeters (cm) and about 6 meters (m), although other stroke lengths are also within the scope of the present disclosure.

The linear actuator module 250 may comprise one or more actuators 258 operable to impart the movement of the shaft 256. For example, the actuator 258 may be a hydraulic pump operable to pressurize hydraulic fluid to power the linear actuator module 250. The actuator 258 may also be implemented as an electrical linear actuator or motor operable to impart movement to the shaft 256 and/or the movable portion 254 as described above. The linear actuator module 250 may further comprise one or more position sensors 259 operable to generate a signal or information indicative of the axial position and/or velocity of the movable portion 254, such as to monitor the position and/or velocity of the testing module 260 with respect to the static portion 252. The sensor 259 may be disposed in association with the linear actuator 250 in a manner permitting sensing of the position and/or velocity of the movable portion 254. The sensor 259 may be or comprise a capacitive sensor, a Hall-effect sensor, an inductive sensor, a linear encoder, a linear potentiometer, a linear variable-differential transformer (LVDT), a magnetic sensor, a proximity sensor, and/or a reed switch.

The testing module 260 may comprise a sample retrieving portion 262 selectively extendable or otherwise outwardly movable to operatively engage the sidewall 103 of the wellbore 102 to retrieve the downhole sample. The testing module 160 may further comprise a selectively extendable or otherwise outwardly movable anchoring member 264 located on opposing side of the sample retrieving portion 262 and operable to maintain the testing module 260 and/or the sample retrieving portion 262 against the sidewall 103 of the wellbore 102. During downhole conveyance or prior to testing operations, the sample retrieving portion 262 and the anchoring member 264 may be in a retracted state, as shown in FIG. 2. Instead of or in addition to the anchoring member 264, the testing module 260 may include one or more inflatable elements operable to push or otherwise maintain the testing module 260 against the sidewall 103. When the tool string 200 is locked in an intended position within the wellbore 102, such as when the gripping members 242 of the anchor module 240 engage the sidewall 103, the sample retrieving portion 262 and the anchoring member 264 may be extended to engage the sidewall 103, as shown in FIG. 3. The testing module 260 may comprise one or more actuators 266 operable to extend and retract the sample retrieving portion 262 and the anchoring member 264. The actuator 266 may be implemented as a hydraulic ram or motor and/or an electric linear actuator or motor. Example implementations of the testing module 160 may include a formation fluid testing tool or module 310 (shown in FIGS. 4 and 5), a formation fluid pressure testing tool or module 410 (shown in FIGS. 6 and 7), and a rock formation testing module such as a coring tool or module 510 (shown in FIGS. 8 and 9).

The sample containment module 270 may be operable to receive the downhole sample from the testing module 260 and store the downhole sample to be analyzed downhole and/or to be retrieved to the wellsite surface 106 for further analysis. For example, the sample containment module 170 may comprise one or more detachable containers 272 disposed or installed within the sample module 270. The detachable containers 272 may receive and store therein the captured rock formation sample and/or the formation fluid sample for subsequent testing at the surface 106.

The power module 230 may be operable to provide power to operate the anchor module 240, the linear actuator module 250, the testing module 260, and/or one or more other components, modules, and/or portions of the tool string 200. For example, similar to as described above the power module 230 may be or comprise a hydraulic power pack, which may be operable to supply hydraulic power to the modules 240, 250, 260. The hydraulic power pack may provide a pressurized hydraulic fluid to the actuators 244, 258, 266 to operate the modules 240, 250. 260 as described above. The power module 216 may also or instead be or comprise an electrical power source, such as a battery. In such implementations, the battery may provide electrical power to the actuators 244, 258, 266 to operate the modules 240, 250, 260 as described above. The power module 216 may also be omitted from the tool string 200, such as in implementations in which the hydraulic and/or electrical power is provided from the wellsite surface 106 via the conveyance means 112.

The tool string 200 may be operated to utilize the testing module 260 at each of different depths within the wellbore 102 without operating the surface equipment to move the entire tool string 200 within the wellbore 102. For example, after the anchor module 240 has been operated to secure the tool string 200 within the wellbore 102, but without operating the linear actuator module 250 to extend the shaft 256, the sample retrieving portion 262 (and perhaps the anchoring member 264) may be extended into engagement with the wellbore sidewall 103, and then the testing module 260 may be operated to perform the sampling, testing, and/or other intended operation. The sample retrieving portion 262 (and the anchoring member 264, if applicable) may then be at least partially retracted to disengage the sidewall 103, and the linear actuator module 250 may be operated to extend the shaft 256 to reposition the testing module 260 to another depth within the wellbore 102. The sample retrieving portion 262 (and perhaps the anchoring member 264) may again be extended into engagement with the wellbore sidewall 103, and then the testing module 260 may be operated to perform the sampling, testing, and/or other intended operation at the new depth. This process may be repeated to perform the sampling, testing, and/or other intended operation at multiple depths within the wellbore 102 without moving the entire tool string 200.

Figure 4:
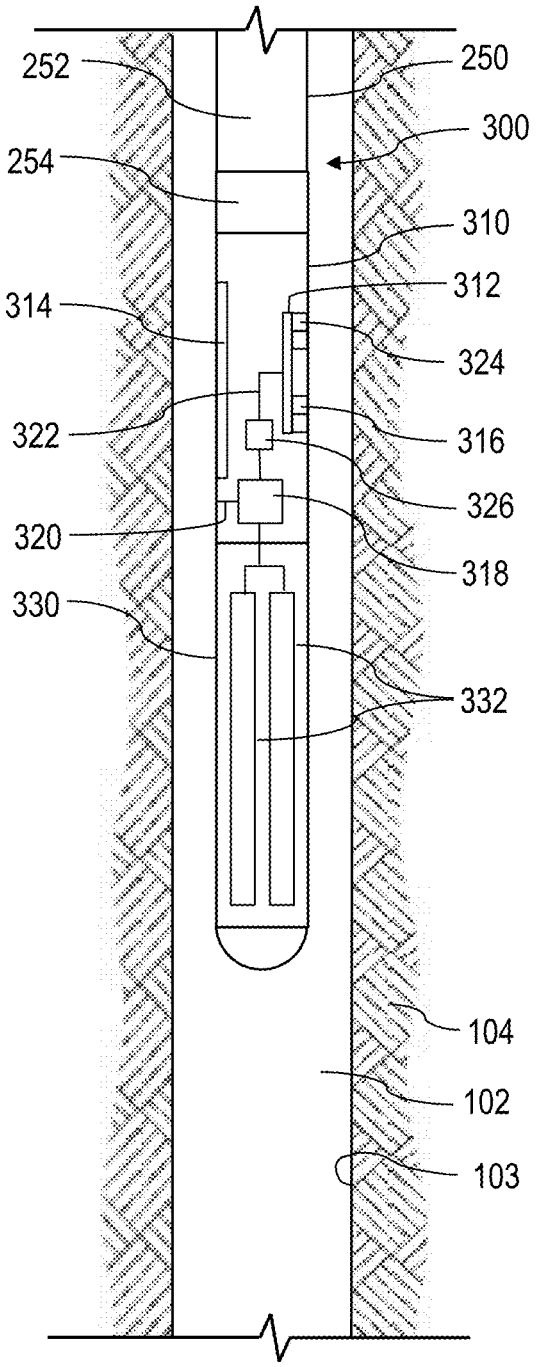
FIG. 4 is a schematic view of a portion of an example implementation of the apparatus shown in FIGS. 2 and 3 according to one or more aspects of the present disclosure.
Figure 5:
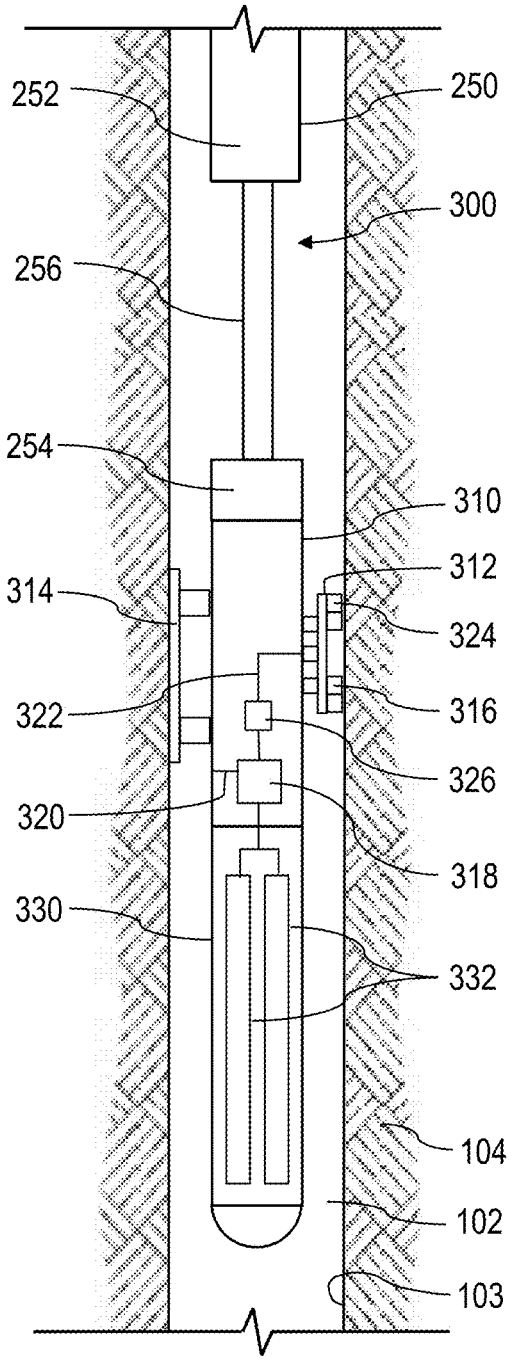
FIG. 5 is a schematic view of the apparatus shown in FIG. 4 at a different stage of operation.

FIGS. 4 and 5 are schematic views of a portion of an example implementation of a tool string 300 in different stages of operation according to one or more aspects of the present disclosure. The tool string 300 comprises one or more similar features of the tool string 200 shown in FIGS. 2 and 3, including where indicated by like reference numbers, except as described below. The following description refers to FIGS. 1-5, collectively.

The testing module 260 of the tool string 200 may be implemented as a formation fluid testing tool or module 310 of the tool string 300. The formation testing module 310 may comprise a selectively extendable probe assembly 312 and a selectively extendable anchoring member 314 that are respectively arranged on opposing sides. The probe assembly 312 and the anchoring member 314 may comprise or be actuated by the actuator 266, which may be operated or powered by the power module 230.

The probe assembly 312 may be operable to engage the sidewall 103 of the wellbore 102 to selectively seal off or isolate a selected portion of the sidewall 103. For example, the probe assembly 312 may comprise a sealing pad 316 that may be urged against the sidewall 103 of the wellbore 102 in a sealing manner to prevent movement of formation fluid into or out of the formation 104 other than through the probe assembly 312. The probe assembly 312 may thus be operable to fluidly couple a pump 318 and/or other components of the formation testing module 310 to the adjacent formation 104. Accordingly, the formation testing module 310 may be utilized to obtain formation fluid samples from the formation 104 by extracting the formation fluid from the formation 104 utilizing the pump 318. The formation fluid samples may thereafter be expelled through a port 320 into the wellbore 102 during a "clean-up" operation until the formation fluid extracted from the formation 104 reaches a sufficiently low contamination level, at which time the extracted formation fluid may be directed to a sample containment module 330.

The sample containment module 330 may contain one or more detachable sample containers or bottles 332 disposed or installed within the sample module 330. The detachable sample bottles 332 may receive and store the captured formation fluid for subsequent testing at the surface 106. The detachable sample bottles 332 may be certified for highway and/or other transportation. Portions of the formation testing module 310 and the sample module 330 may also comprise a flowline 322 for passing the formation fluid from the probe assembly 312, through the formation fluid testing module 310 and into the sample module 330.

The probe assembly 312 of the formation fluid testing module 310 may comprise one or more sensors 324 adjacent the probe assembly 312, among other possible locations. The sensors 324 may be utilized in the determination of petrophysical parameters of a portion of the formation 104 proximate the probe assembly 312. For example, the sensors 324 may be utilized to measure or detect one or more of pressure, temperature, composition, electric resistivity, dielectric constant, magnetic resonance relaxation time, nuclear radiation, and/or combinations thereof, although other types of sensors are also within the scope of the present disclosure. The formation fluid testing module 310 may also comprise a fluid sensing unit 326 through which obtained formation fluid may flow, such as to measure properties and/or composition data of the sampled fluid. For example, the fluid sensing unit 326 may comprise one or more of a spectrometer, a fluorescence sensor, an optical fluid analyzer, a density and/or viscosity sensor, and/or a pressure and/or temperature sensor, among other examples.

During downhole conveyance or prior to testing operations, the probe assembly 312 and the anchoring member 314 may be in a retracted state, as shown in FIG. 4. When the tool string 300 is locked in an intended position along the wellbore 102, such as when the gripping members 242 of the anchor module 240 engage the sidewall 103, the probe assembly 312 and the anchoring member 314 may extend to engage the sidewall 103, as shown in FIG. 5.

Similar to as described above, the tool string 300 may be operated to utilize the fluid testing module 310 at each of different depths within the wellbore 102 without operating the surface equipment to move the entire tool string 300 within the wellbore 102. For example, after the anchor module 240 has been operated to secure the tool string 200 within the wellbore 102, but without operating the linear actuator module 250 to extend the shaft 256, the probe assembly 312 (and perhaps the anchoring member 314) may be extended into engagement with the wellbore sidewall 103, and then the fluid testing module 310 may be operated to perform the sampling operation. The probe assembly 312 (and the anchoring member 314, if applicable) may then be at least partially retracted to disengage the sidewall 103, and the linear actuator module 250 may be operated to extend the shaft 256 to reposition the fluid testing module 310 to another depth within the wellbore 102. The probe assembly 312 (and perhaps the anchoring member 314) may again be extended into engagement with the wellbore sidewall 103, and then the fluid testing module 310 may be operated to perform another sampling operation at the new depth. This process may be repeated to perform sampling operations at multiple depths within the wellbore 102 without moving the entire tool string 300.

Figure 6:
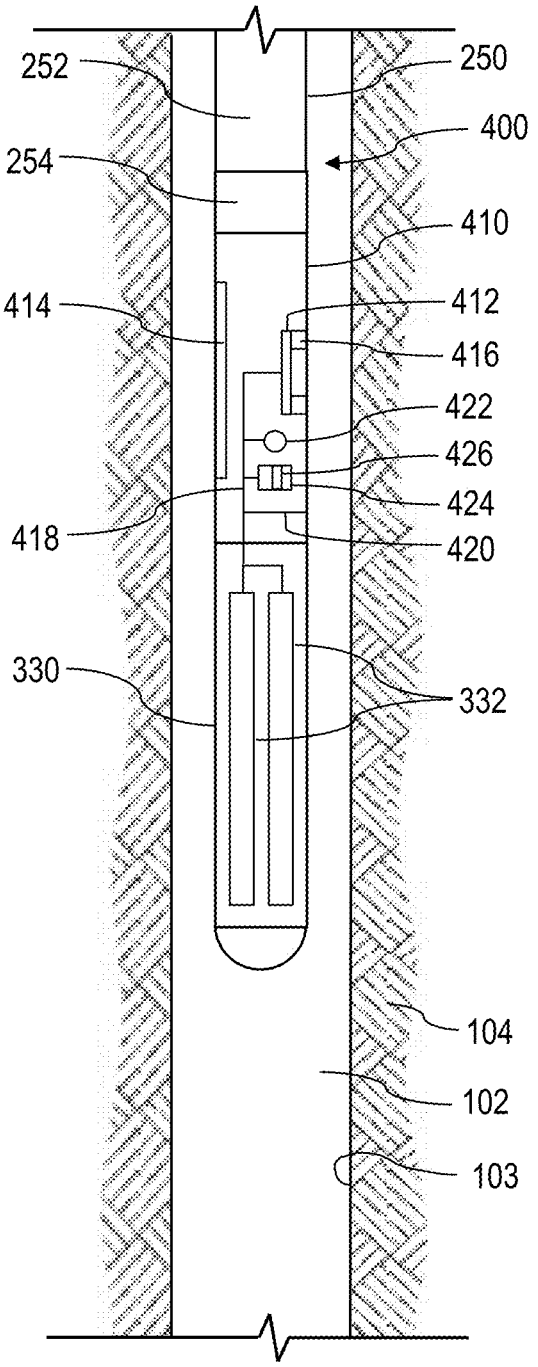
FIG. 6 is a schematic view of a portion of an example implementation of the apparatus shown in FIGS. 2 and 3 according to one or more aspects of the present disclosure.
Figure 7:
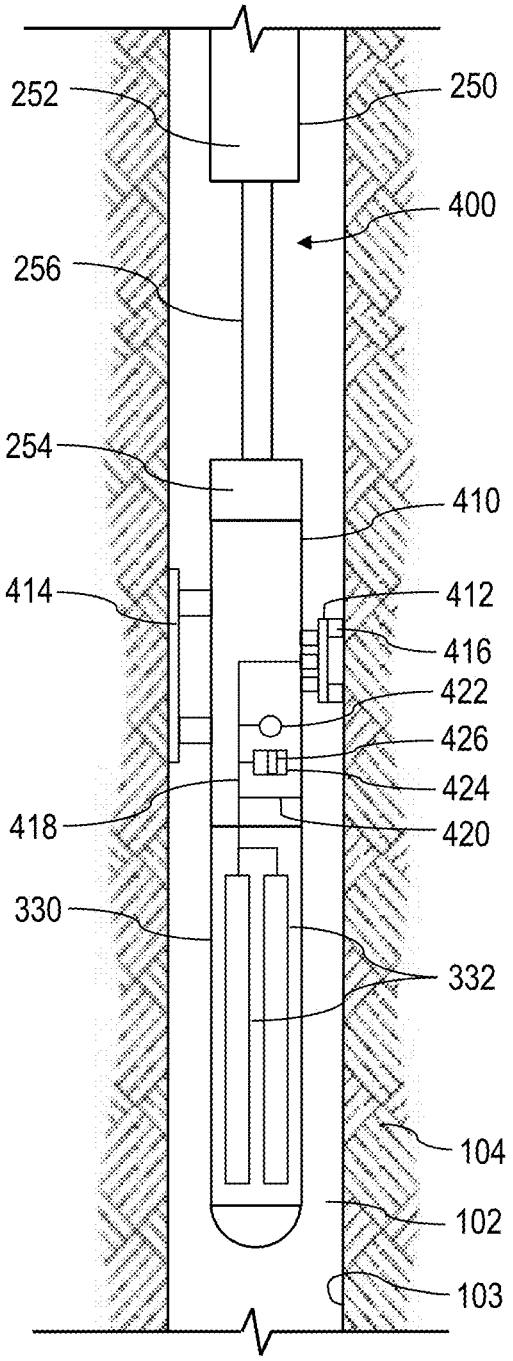
FIG. 7 is a schematic view of the apparatus shown in FIG. 6 at a different stage of operation.

FIGS. 6 and 7 are schematic views of a portion of an example implementation of a tool string 400 in different stages of operation according to one or more aspects of the present disclosure. The tool string 400 comprises one or more similar features of the tool string 200 shown in FIGS. 2 and 3, including where indicated by like reference numbers, except as described below. The following description refers to FIGS. 1-3, 6, and 7, collectively.

The testing module 260 of the tool string 200 may be implemented as a formation pressure testing tool or module 410 of the tool string 400, such as may be operable to monitor pressure of the formation fluid trapped within the formation 104. The testing module 410 may comprise a selectively extendable probe assembly 412 and a selectively extendable anchoring member 414 that are respectively arranged on opposing sides. The probe assembly 412 and the anchoring member 414 may comprise or be actuated by the actuator 266, which may be operated or powered by the power module 230. During downhole conveyance or prior to the formation pressure testing operations, the probe assembly 412 and the anchoring member 414 may be in a retracted state, as shown in FIG. 6. When the tool string 400 is locked in an intended position along the wellbore 102, such as when the gripping members 242 of the anchor module 240 engage the sidewall 103, the probe assembly 412 and the anchoring member 414 may extend to engage the sidewall 103, as shown in FIG. 7.

The probe assembly 412 may be operable to engage the sidewall 103 of the wellbore 102 to selectively seal off or isolate a portion of the sidewall 103. For example, the probe assembly 412 may comprise a sealing pad 416 that may be urged against the sidewall 103 in a sealing manner to prevent movement of formation fluid into or out of the formation 104 other than through the probe assembly 412. The formation fluid extracted via the probe assembly 412 may be directed into and through the testing module 410 via a flowline 418, which may be fluidly connected with other modules and/or with a port 420 to fluidly connect the flowline 418 with the wellbore 102. The formation fluid may be expelled through the port 420 into the wellbore 102 during a "clean-up" operation until the formation fluid extracted from the formation 104 reaches a sufficiently low contamination level, at which time the pressure testing operations may be performed. The testing module 410 may comprise a chamber 424 and a pressure sensor 422 fluidly connected with the flowline 418. The pressure chamber 424 may include a piston 426 slidably disposed therein. The pressure sensor 422 may be operable to generate a signal indicative of the pressure along the flowline 418 and the pressure chamber 424, such as may be utilized to monitor or record the pressure along the flowline 418 and the pressure chamber 424.

After a fluid seal is achieved between the probe assembly 412 and the sidewall 103, and perhaps after the clean-up operation is performed, the piston 426 may be retracted in the chamber 424 to create a pressure drop in the flowline 418 below the formation pressure to draw the formation fluid into the testing module 410. When the piston 426 stops retracting, the formation fluid may continue to enter the flowline 418 and the chamber 424 via the probe assembly 412 until the pressure of the formation fluid in the chamber 412 and the flowline 418 is substantially equal to the pressure of the formation fluid in the formation 104. The pressure recorded by the pressure sensor 422 when the formation fluid stops flowing into the chamber 424 may be the formation pressure or may be indicative of the formation pressure. The pressure signal generated by the pressure sensor 422 may also be utilized to monitor quality of the pressure test and/or quality of the fluid seal between the probe assembly 412 and the sidewall 103. For example, if the pressure recorded by the pressure sensor 422 does not steadily decrease while the piston 426 is retracting, then the probe assembly 412 may not be sealingly engaged with the sidewall 103, thus permitting wellbore fluid to enter the probe assembly 412 and perhaps compromising the testing. Furthermore, if the pressure recorded by the pressure sensor 422 does not steadily increase after the piston 426 stops retracting, then the probe assembly 412 or the flowline 418 may be blocked or contaminated, rendering the pressure test as failed.

Prior to or after the pressure testing operations, the testing module 410 may communicate the received formation fluid to other modules of the tool string 400, including the sample containment module 330 and/or a formation fluid testing module, such as the formation fluid testing module 310 (shown in FIGS. 4 and 5), which may be coupled within the tool string 400 between the formation pressure testing module 410 and the containment module 330. The pressure testing may also be performed without performance of the clean-up operation, including in implementations in which the probe assembly 412 may not be utilized (or even configured for) receiving fluid from the formation but is instead operated to establish fluid communication with the formation so as to measure pressure of fluid in the formation.

Similar to as described above, the tool string 400 may be operated to utilize the pressure testing module 410 at each of different depths within the wellbore 102 without operating the surface equipment to move the entire tool string 400 within the wellbore 102. For example, after the anchor module 240 has been operated to secure the tool string 400 within the wellbore 102, but without operating the linear actuator module 250 to extend the shaft 256, the probe assembly 412 (and perhaps the anchoring member 414) may be extended into engagement with the wellbore sidewall 103, and then the pressure testing module 410 may be operated to perform the pressure testing operation. The probe assembly 412 (and the anchoring member 414, if applicable) may then be at least partially retracted to disengage the sidewall 103, and the linear actuator module 250 may be operated to extend the shaft 256 to reposition the pressure testing module 410 to another depth within the wellbore 102. The probe assembly 412 (and perhaps the anchoring member 414) may again be extended into engagement with the wellbore sidewall 103, and then the pressure testing module 310 may be operated to perform another testing operation at the new depth. This process may be repeated to perform pressure testing operations at multiple depths within the wellbore 102 without moving the entire tool string 400.

Figure 8:
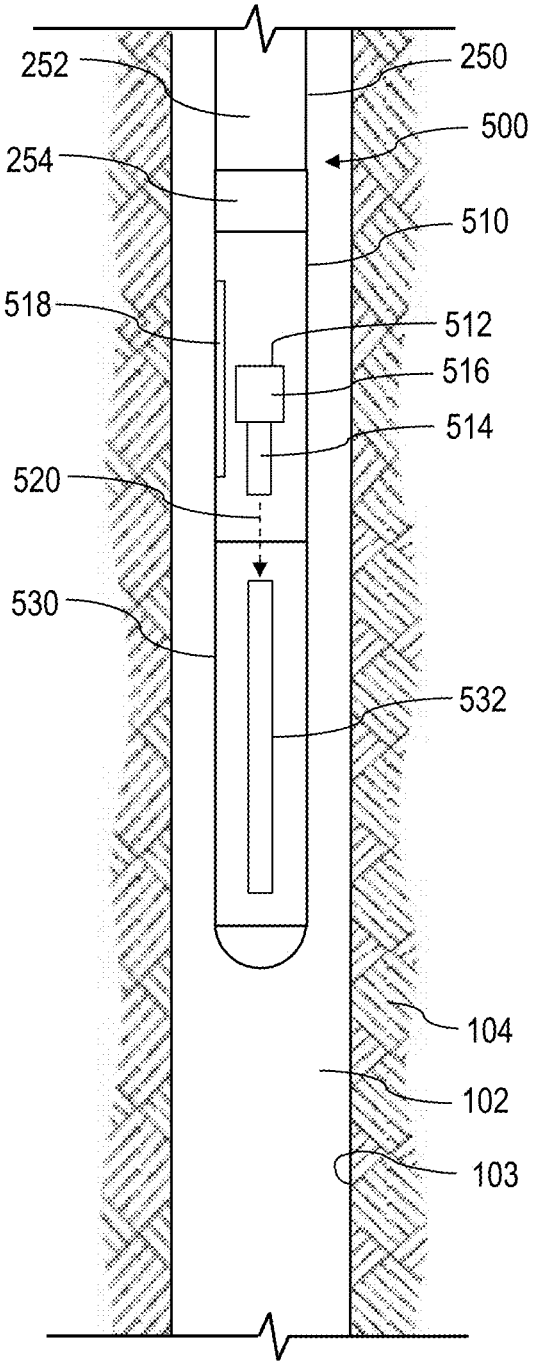
FIG. 8 is a schematic view of a portion of an example implementation of the apparatus shown in FIGS. 2 and 3 according to one or more aspects of the present disclosure.
Figure 9:
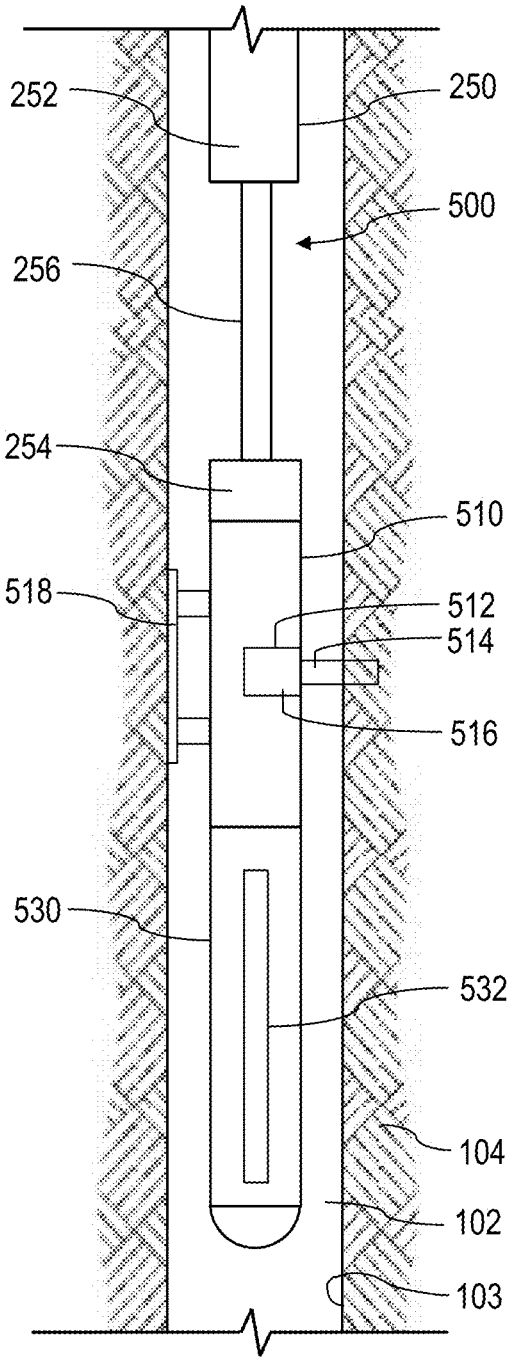
FIG. 9 is a schematic view of the apparatus shown in FIG. 8 at a different stage of operation.

FIGS. 8 and 9 are schematic views of a portion of an example implementation of a tool string 500 in different stages of operation according to one or more aspects of the present disclosure. The tool string 500 comprises one or more similar features of the tool string 200 shown in FIGS. 2 and 3, including where indicated by like reference numbers, except as described below. The following description refers to FIGS. 1-3, 8, and 9, collectively.

The testing module 260 of the tool string 200 may be implemented as a formation coring tool or module 510 of the tool string 500, such as may be operable to obtain one or more rock formation samples, referred to as core samples, from the sidewall 103 of the wellbore 102. The coring module 510 may comprise a selectively movable coring assembly 512, which may include a coring bit 514 and an associated actuation mechanism 516 for rotating the coring bit 514. The coring module 510 may further comprise a selectively extendable brace arm or anchoring member 518.

The coring assembly 512 may be selectively translatable or otherwise movable within the coring module 510 to extend the coring bit 514 from the coring module 510 and engage the sidewall 103 of the wellbore 102 to cut a core sample from the sidewall 103. The coring assembly 512 may then be operated to retract the coring bit 514 from the sidewall 103 into the coring module 510 while retaining the core sample within the coring bit 514. During the coring operations, the anchoring member 518 may extend against the sidewall 103 of the wellbore 102 to maintain the tool string 500 and/or the coring module 510 in position against the sidewall 103. The coring assembly 512 and the anchoring member 518 may comprise or be actuated by the actuator 266, which may be operated or powered by the power module 230.

After the coring bit 514 is retracted, the coring module 510 may push or otherwise move the core sample into a core sample containment module 530, as indicated by arrow 520. The core sample containment module 530 may contain one or more detachable core sample containers or tubes 532 disposed or installed within the core sample containment module 530. The detachable tubes 532 may receive and store the cut core samples for subsequent testing at the surface 106. The detachable tubes 532 may be certified for highway and/or other transportation.

During downhole conveyance or prior to coring operations, the coring assembly 512 and the anchoring member 518 may be in a retracted state, as shown in FIG. 8. When the tool string 500 is locked in an intended position along the wellbore 102, such as when the gripping members 242 of the anchor module 240 engage the sidewall 103, the coring bit 514 of the coring assembly 512 and the anchoring member 518 may extend outward to engage the sidewall 103, as shown in FIG. 9.

Similar to as described above, the tool string 500 may be operated to utilize the coring module 510 at each of different depths within the wellbore 102 without operating the surface equipment to move the entire tool string 500 within the wellbore 102. For example, after the anchor module 240 has been operated to secure the tool string 400 within the wellbore 102, but without operating the linear actuator module 250 to extend the shaft 256, the coring bit 514 (and perhaps the anchoring member 518) may be extended into engagement with the wellbore sidewall 103, and then the coring module 510 may be operated to perform the coring operation. The coring bit 514 (and the anchoring member 518, if applicable) may then be at least partially retracted to disengage the sidewall 103, and the linear actuator module 250 may be operated to extend the shaft 256 to reposition the coring module 510 to another depth within the wellbore 102. The coring bit 514 (and perhaps the anchoring member 518) may again be extended into engagement with the wellbore sidewall 103, and then the coring module 510 may be operated to perform another coring operation at the new depth. This process may be repeated to perform coring operations at multiple depths within the wellbore 102 without moving the entire tool string 500.

Figure 10:
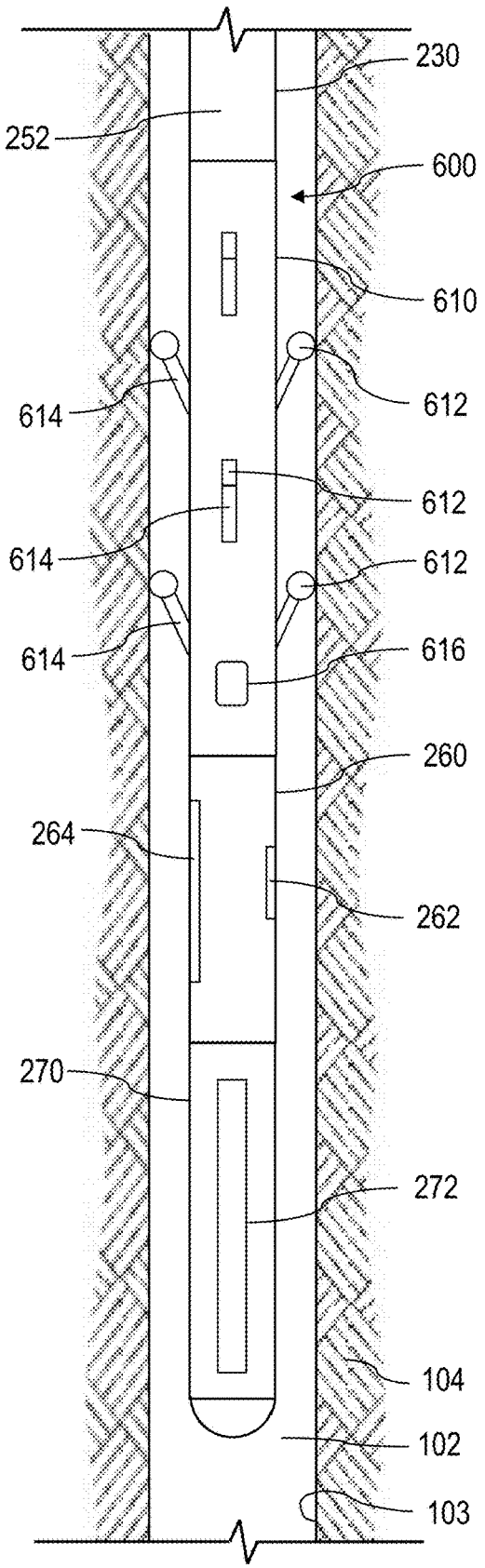
FIG. 10 is a schematic view of a portion of an example implementation of the apparatus shown in FIGS. 2 and 3 according to one or more aspects of the present disclosure.

FIG. 10 is a schematic view of a portion of an example implementation of a tool string 600 according to one or more aspects of the present disclosure. The tool string 600 comprises one or more similar features of the tool string 200 shown in FIGS. 2 and 3, including where indicated by like reference numbers, except as described below. The following description refers to FIGS. 1-3, and 10, collectively.

Instead of utilizing the linear actuator module 250 in combination with the anchor module 240 to selectively maintain and move the testing module 260 and the sample containment module 270 relative to the wellbore 102, the tool string 600 comprises a tractor module 610 operable to both maintain the tool string 600 in position within the wellbore 102 and longitudinally move the tool string 600 within the wellbore 102. The tractor module 610 may be or comprise a downhole tractor comprising a plurality of tractor rollers or drives 612 extendable or movable outward against the sidewall 103 of the wellbore 102 via corresponding arms 614 to grip the sidewall 103. The tractor drives 612 may be operated to rotate while in contact with the sidewall 103 to move the tool string 600 in a controlled manner in an uphole or downhole direction within the wellbore 102. The tractor drives 612 and the arms 614 may be operatively connected with and actuated by one or more actuators 616 operable to extend the arms 614 and rotate the drives 612. The actuators 616 may be or comprise, for example, hydraulic rams, hydraulic motors, linear electric motors, and/or rotary electric motors. The individual tractor drives 612, the arms 614, and/or the actuators 616 may be operated or powered by the power module 230. Accordingly, after the tool string 600 is conveyed via the tensioning device 113 and the conveyance means 112, the tractor module 610 may extend the tractor drives 612 into engagement with the sidewall 103 and rotate the tractor drives 612 to move the tool string 600, including the testing module 260, in a precise and controlled manner to position the testing module 260 at selected depths within the wellbore 102.

However, as described above, tractors utilizing rotating drives may be susceptible to slippage between the rotating drives 612 and the sidewall 103 in some applications, which may reduce the ability to precisely move and position the tool string 600 and the testing module 260 within the wellbore 102. Accordingly, the tool string 600 may also include the linear actuator module 250, which may be operated to move the testing module 260 with precision along the wellbore 102 when the tractor 610 is fixed in position along the wellbore 102. Thus, the tractor 610 may be utilized to anchor the tool string 600 against the sidewall 103 and also to move the tool string 600 along highly deviated wellbores 102 and/or dislodge the tool string 600 if it becomes stuck along the wellbore 102.

Figure 11:
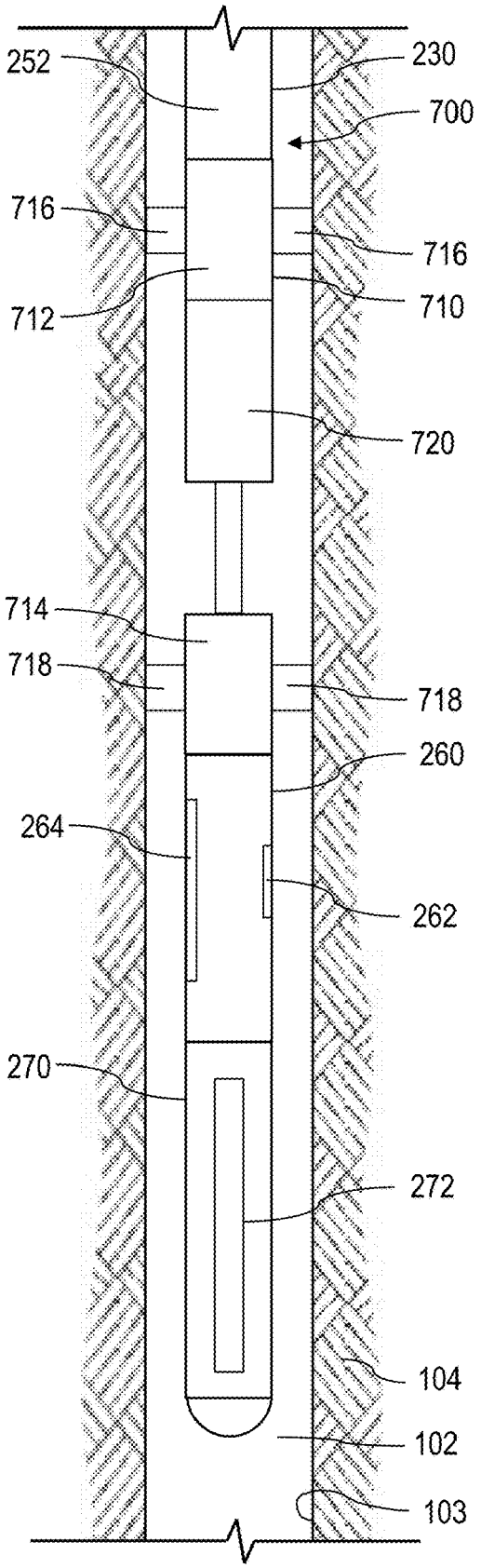
FIG. 11 is a schematic view of a portion of an example implementation of the apparatus shown in FIGS. 2 and 3 according to one or more aspects of the present disclosure.

FIG. 11 is a schematic view of a portion of an example implementation of a tool string 700 according to one or more aspects of the present disclosure. The tool string 700 comprises one or more similar features of the tool string 200 shown in FIGS. 2 and 3, including where indicated by like reference numbers, except as described below. The following description refers to FIGS. 1-3, and 11, collectively.

Instead of utilizing the linear actuator module 250 in combination with the anchor module 240 to selectively maintain and move the testing module 260 and the sample containment module 270 along the wellbore 102, the tool string 700 may comprise a tractor module 710 operable to both maintain the tool string 700 in position within the wellbore 102 and longitudinally move the tool string 700 along the wellbore 102. The tractor module 710 may be or comprise a downhole tractor utilizing an inchworm principle with two or more sections alternatingly gripping the sidewall 103 while one or more sections reset or advance longitudinally along the wellbore 102.

For example, the tractor module 710 may comprise a first anchor 712 connected with the power module 230 and a second anchor 714 connected with the testing module 260. The first and second anchors 712, 714 may each comprise sets of gripping members 716, 718, respectively, located on opposing sides of each anchor 712, 714. Each set of gripping members 716, 718 may be operable to selectively extend outward to engage and grip the sidewall 103 of the wellbore 102. The tractor module 710 may further comprise a linear actuator 720, such as a ram or a stroker, connected or otherwise disposed between the anchors 712, 714. The anchors 712, 714 may be alternatingly moved toward and away from each other by the linear actuator 720 as the sets of gripping members 716, 718 alternatingly engage and disengage the sidewall 103 to move the tool string 700 longitudinally within the wellbore 102. For example, to advance the tool string 700 in the downhole direction, after the gripping members 716 of the first anchor 712 are operated to grip the sidewall 103, the linear actuator 720 may extend to move the testing module 260 and the sample containment module 270 in the downhole direction. Thereafter, the gripping members 718 of the second anchor 714 may grip the sidewall 103, the gripping members 716 may disengage from the sidewall 103 and the linear actuator 720 may retract to move the anchor 710 and the power module 230 in the downhole direction. Such process may be repeated until the testing module 260 is positioned in at multiple intended positions within the wellbore 102. The anchors 712, 714 and the linear actuator 720 may be operatively connected with and powered by the power module 230.

Figure 12:
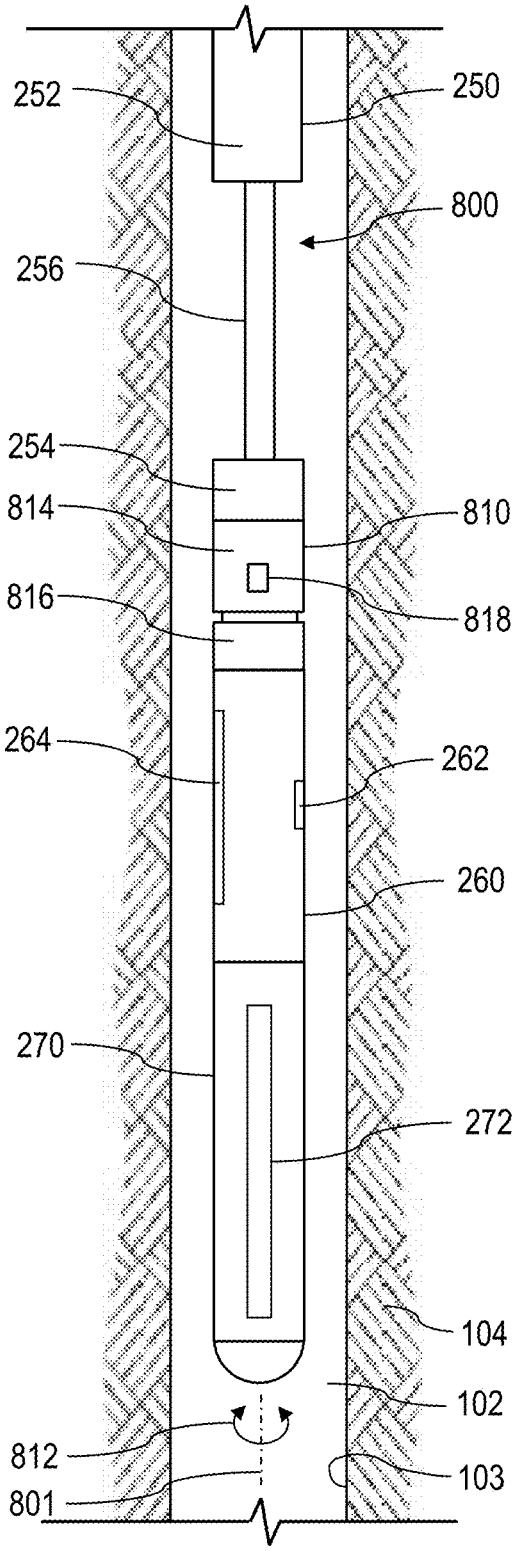
FIG. 12 is a schematic view of a portion of an example implementation of the apparatus shown in FIGS. 2 and 3 according to one or more aspects of the present disclosure.

FIG. 12 is a schematic view of a portion of an example implementation of a tool string 800 according to one or more aspects of the present disclosure. The tool string 800 comprises one or more similar features of the tool string 200 shown in FIGS. 2 and 3, including where indicated by like reference numbers, except as described below. The following description refers to FIGS. 1-3, and 12, collectively.

In addition to utilizing the linear actuator module 250 or the tractors 610, 710 to move the testing module 260 and the sample containment module 270 longitudinally within the wellbore 102, the tool string 800 may also comprise a rotary actuator module 810 coupled between the linear actuator module 250 or tractors 610, 710 and the testing module 260, such as may be operable to rotate the testing module 260 and the sample containment module 270 about an axis 801 of the tool string 800, as indicated by arrow 812. For example, during downhole operations, the rotary actuator module 810 may be operable to azimuthally rotate the sample retrieving portion 262, such as to perform multiple tests and/or retrieve multiple downhole samples at the same wellbore depth but at different azimuthal locations, or in an attempt to re-engage the sample retrieving portion 262 with the sidewall 103 at different azimuthal positions if prior engagement(s) and/or tests have failed.

The rotary actuator module 810 may comprise a static portion 814 coupled with the movable portion 254 of the linear actuator 250, and a rotary portion 816 coupled with the testing module 260. The static portion 814 may be or comprise a hydraulic or electric motor operable to continuously and/or incrementally rotate the rotary portion 816, and thus the testing module 260, to change the azimuthal direction of the sample retrieving portion 262 within the wellbore 102. The rotary actuator module 810 may be operatively connected with and powered by the power module 230.

The rotary actuator module 810 may further comprise one or more position sensors 818 operable to generate a signal or information indicative of rotational position and/or rotational speed of the rotary portion 816. The sensor 818 may be mounted in association with the rotary actuator module 810 in a manner permitting sensing of the position and/or velocity of the rotary portion 816. The sensor 818 may be or comprise an encoder, a resolver, a rotary potentiometer, an RVDY, and/or a synchro, among other examples.

Figure 13:
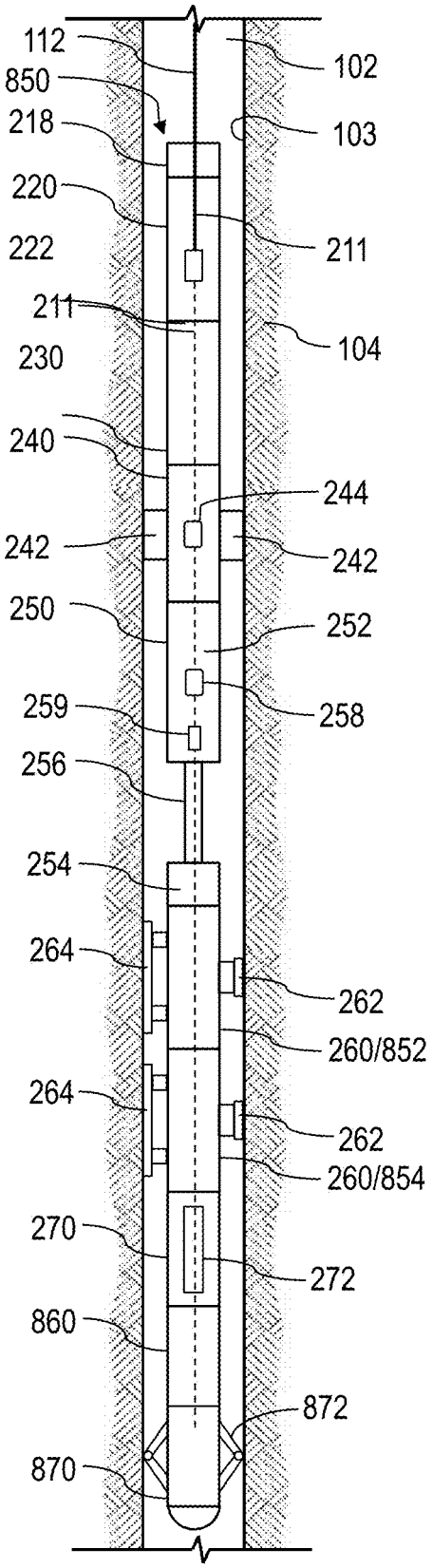
FIG. 13 is a schematic view of a portion of an example implementation of the apparatus shown in FIGS. 2 and 3 according to one or more aspects of the present disclosure.

FIG. 13 is a schematic view of a portion of an example implementation of a tool string 850 according to one or more aspects of the present disclosure. The tool string 850 comprises one or more similar features of the tool string 200 shown in FIGS. 2 and 3, including where indicated by like reference numbers, except as described below. The following description refers to FIGS. 1-3 and 13, collectively.

The tool string 850 may comprise one or more instances of the testing module 260, each of which may be implemented as the formation fluid testing module 310 of the tool string 300, the pressure testing module 410 of the tool string 400, the coring module 510 of the tool string 300, or modules for other types of testing. For example, in the example implementation depicted in FIG. 13, the tool string 850 comprises an upper testing module 852 and a lower testing module 854. The upper testing module 852 may be implemented as the fluid testing (e.g., sampling) module 310 of the tool string 300 or the pressure testing module 410 of the tool string 400, and the lower testing module 854 may be implemented as the coring module 510 of the tool string 300. However, other combinations of two or more instances of the testing module 260 are also within the scope of the present disclosure.

Similar to as described above, the tool string 850 may be operated to utilize the testing module(s) 260 at each of different depths within the wellbore 102 without operating the surface equipment to move the entire tool string 850 within the wellbore 102. For example, after the anchor module 240 has been operated to secure the tool string 850 within the wellbore 102, but without operating the linear actuator module 250 to extend the shaft 256, the testing portion(s) 262 (e.g., the probe assembly 312, 412 and/or coring bit 514) and perhaps the anchoring member(s) 264 may be extended into engagement with the wellbore sidewall 103, and then the testing module(s) 260 may be operated to perform the testing operation(s). The testing portion(s) 262 and the anchoring member(s) 264 may then be at least partially retracted to disengage the sidewall 103, and the linear actuator module 250 may be operated to extend the shaft 256 to reposition the testing module(s) 260 to another depth within the wellbore 102. The testing portion(s) 262 and the anchoring member(s) 264 may again be extended into engagement with the wellbore sidewall 103, and then the testing module(s) 260 may be operated to perform the testing operation(s) at the new depth. This process may be repeated to perform testing operations at multiple depths within the wellbore 102 without moving the entire tool string 850.

The tool string 850 also comprises an imaging module 860. The imaging module 860 is operable to obtain an image, or data utilized to generate such image, of the surrounding formation 102. The imaging module 860 may be or comprise an acoustic, nuclear, sonic, and/or ultrasonic imaging tool. Examples of the imaging module 860 and/or tools thereof include Schlumberger's Accelerator Porosity Sonde (APS), Azimuthal Resistivity Imager (ARI), Combinable Magnetic Resonance tool (CMR), Compensated Neutron Log tool (CNL), Elemental Capture Spectroscopy sonde (ECS), Fullbore Formation Microimager tool (FMI), High-Definition Formation Microimager tool (FMI-HD), High-Resolution Laterolog Array tool (HRLA), Hostile Environment Natural Gamma Ray Sonde (HNGS), Integrated Porosity Lithology tools/services (IPL, for formation porosity and lithology information from neutron porosity, natural gamma ray spectrometry, density, and photoelectric effect), Natural Gamma Ray Spectrometry tool (NGS), Oil-Base Microimager tool (OBMI), QUANTA GEO photorealistic reservoir geology tool for imaging in oil-base mud (OBM), and Ultrasonic Borehole Imager tool (UBI).

Implementations of tool strings that include the imaging module 860 may permit obtaining a wellbore image over a specific interval of interest, using the precise movement attainable with the linear actuator module 250. Such imaging may be utilized to select the testing/coring location and/or interval, perhaps with an accuracy of less than five mm, such that the fluid testing/sampling probe 312, the pressure probe 412, and/or the coring bit 512 may be precisely located utilizing the reference image log obtained with the imaging module 860. For example, an image of the interval of interest may be obtained with the imaging module 860 while moving the imaging module 860 within the interval via operation of the linear actuation module 250, and then the linear actuation module 250 may be operated to move the fluid testing/sampling probe 312, the pressure probe 412, and/or the coring bit 512 to the precise location within the interval that is indicated in the image as being ideal for the intended fluid testing, pressure testing, and/or coring operation. The testing and/or coring operation may also be repeated at multiple locations within the interval (i.e., within the length of the stroke of the linear actuator module 250).

Such implementations may also permit the automation of tool positioning within the interval, such as for fast and accurate probe and/or bit positioning. The pulling capacity of the linear actuator module 250 may also be used as an unsticking mechanism when the fluid/pressure testing probe 312, 42 or the coring bit 512 becomes stuck after testing/coring operations.

Implementations of the tool string 850 within the scope of the present disclosure may also include the rotary actuator module 810 of the tool string 800 shown in FIG. 12, whether instead of or in addition to the linear actuator module 250. Accordingly, the precise positioning of the testing/sampling probe 312, the pressure probe 412, and/or the coring bit 512 based on the image obtained with the imaging module 860 may be linear and/or azimuthal positioning. Implementations within the scope of the present disclosure also include those in which the functionality of the linear actuator module 250 and the rotary actuator module 810 are combined in a single module or other device capable of imparting both linear and rotary motion.

Although FIGS. 1-9 and 12 depict example implementations of the respective tool strings comprising one testing module 160, 260, and although FIGS. 1-9, 12, and 13 depict example implementations of the respective tool strings comprising one anchor module 140, 240, and one linear actuator 250, other tool string implementations within the scope of the present disclosure may utilize two or more anchor modules 140, 240, two or more linear actuators 250, and two or more testing modules 160, 260 coupled between sets of anchor modules 140, 240 and linear actuators 250. In additional to the functionality described above, such implementations may permit one or more testing modules 160, 260 to perform testing operations while another one or more testing modules 160, 260 are being moved longitudinally within the wellbore 102 toward subsequent test positions.

Figure 14:
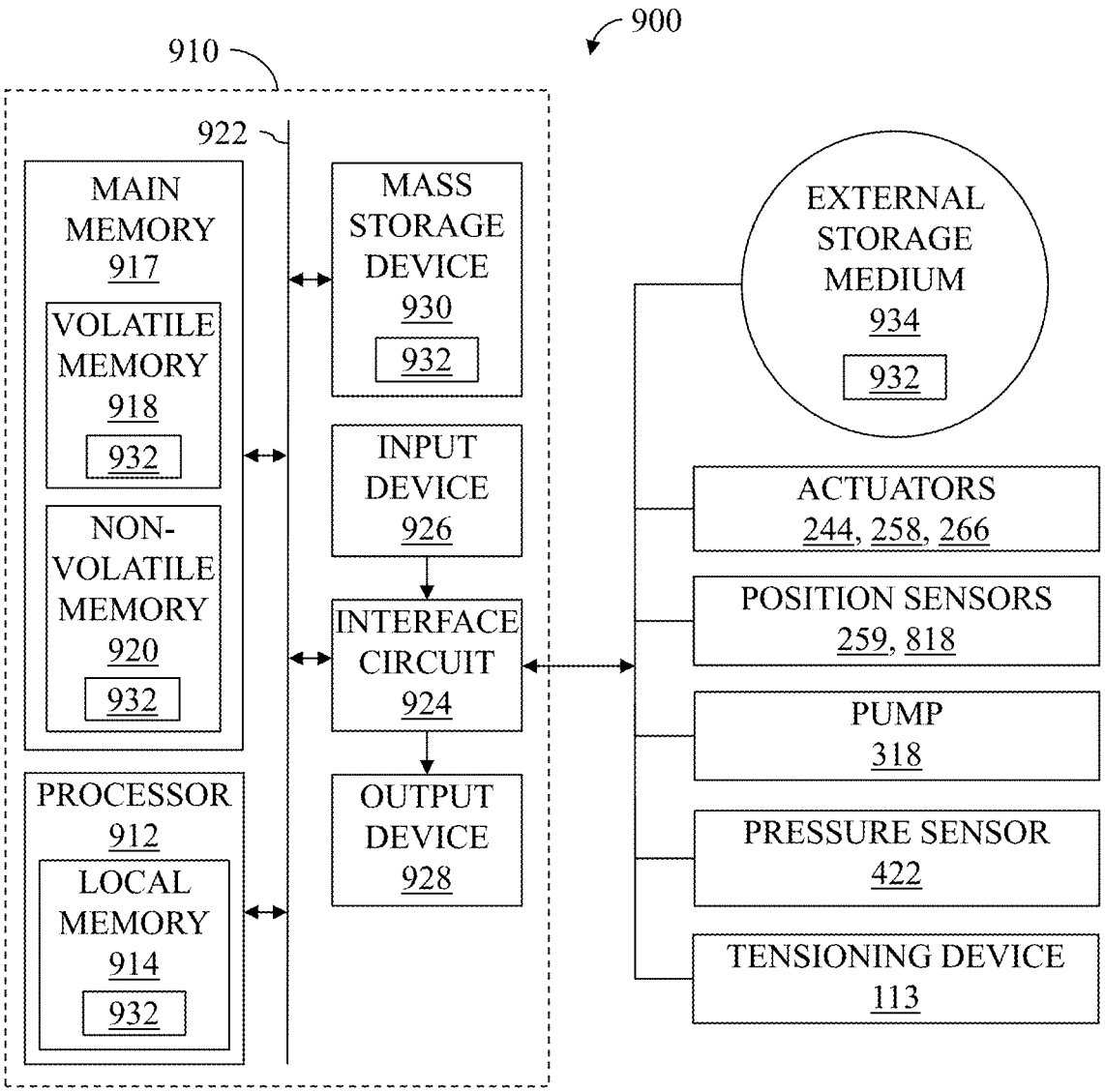
FIG. 14 is a schematic view of at least a portion of an example implementation of apparatus according to one or more aspects of the present disclosure.

Various portions of the apparatus described above and shown in FIGS. 1-13, may collectively form and/or be controlled by a control system, such as may be operable to monitor and/or control at least some operations of the wellsite system 100, including operations of the tool string 200. FIG. 14 is a schematic view of at least a portion of an example implementation of such a control system 900 according to one or more aspects of the present disclosure. The following description refers to one or more of FIGS. 1-14.

The control system 900 may comprise a controller 910, which may be in communication with various portions of the wellsite system 100, including the tensioning device 113 and the modules of the tool string 200 described within the scope of the present disclosure. For example, the controller 910 may be in signal communication with the actuators 244, 258, 266, the position sensors 259, 818, the pump 318, the pressure sensor 422, the tensioning device 113, and/or other actuators and sensors of the wellsite system 100 and the tool string 200. For clarity, these and other components in communication with the controller 910 will be collectively referred to hereinafter as "actuator and sensor equipment." The controller 910 may be operable to receive coded instructions 932 from the human operator and signals generated by the position sensors 259, 818 and the pressure sensor 422, process the coded instructions 932 and the signals, and communicate control signals to the actuators 244, 258, 266, the pump 318, and/or the tensioning device 113 to execute the coded instructions 932 to implement at least a portion of one or more example methods and/or processes described herein, and/or to implement at least a portion of one or more of the example systems described herein. The controller 910 may be or comprise one or more of the processing systems 115, 122 described above.

The controller 910 may be or comprise, for example, one or more processors, special-purpose computing devices, servers, personal computers (e.g., desktop, laptop, and/or tablet computers) personal digital assistant (PDA) devices, smartphones, internet appliances, and/or other types of computing devices. The controller 910 may comprise a processor 912, such as a general-purpose programmable processor. The processor 912 may comprise a local memory 914, and may execute coded instructions 932 present in the local memory 914 and/or another memory device. The processor 912 may execute, among other things, the machine-readable coded instructions 932 and/or other instructions and/or programs to implement the example methods and/or processes described herein. The programs stored in the local memory 914 may include program instructions or computer program code that, when executed by an associated processor, facilitate the wellsite system 100 and the tool string 200 to perform the example methods and/or processes described herein. The processor 912 may be, comprise, or be implemented by one or more processors of various types suitable to the local application environment, and may include one or more of general-purpose computers, special-purpose computers, microprocessors, digital signal processors (DSPs), field-programmable gate arrays (FPGAs), application-specific integrated circuits (ASICs), and processors based on a multi-core processor architecture, as non-limiting examples. Of course, other processors from other families are also appropriate.

The processor 912 may be in communication with a main memory 917, such as may include a volatile memory 918 and a non-volatile memory 920, perhaps via a bus 922 and/or other communication means. The volatile memory 918 may be, comprise, or be implemented by random access memory (RAM), static random access memory (SRAM), synchronous dynamic random access memory (SDRAM), dynamic random access memory (DRAM), RAMBUS dynamic random access memory (RDRAM), and/or other types of random access memory devices. The non-volatile memory 920 may be, comprise, or be implemented by read-only memory, flash memory, and/or other types of memory devices. One or more memory controllers (not shown) may control access to the volatile memory 918 and/or non-volatile memory 920.

The controller 910 may also comprise an interface circuit 924. The interface circuit 924 may be, comprise, or be implemented by various types of standard interfaces, such as an Ethernet interface, a universal serial bus (USB), a third generation input/output (3GIO) interface, a wireless interface, a cellular interface, and/or a satellite interface, among others. The interface circuit 924 may also comprise a graphics driver card. The interface circuit 924 may also comprise a communication device, such as a modem or network interface card to facilitate exchange of data with external computing devices via a network (e.g., Ethernet connection, digital subscriber line (DSL), telephone line, coaxial cable, cellular telephone system, satellite, etc.). One or more of the actuator and sensor equipment may be connected with the controller 910 via the interface circuit 924, such as may facilitate communication between the actuator and sensor equipment and the controller 910.

One or more input devices 926 may also be connected to the interface circuit 924. The input devices 926 may permit the human operators to enter the coded instructions 932, including control commands, operational set-points, and/or other data for use by the processor 912. The operational set-points may include, as non-limiting examples, a stop position within the wellbore 102 to which the tensioning device 113 conveys the testing module 260, test positions distributed longitudinally along the wellbore 102 at which the testing module 260 is to perform the testing operations, test positions distributed azimuthally along the wellbore 102 at which the testing module 260 is to perform the testing operations, longitudinal and azimuthal distances between the test positions, and longitudinal and azimuthal distances from the test positions at which the testing module 260 is to perform subsequent testing operations following failed testing operations. The input devices 926 may be, comprise, or be implemented by a keyboard, a mouse, a touchscreen, a track-pad, a trackball, an isopoint, and/or a voice recognition system, among other examples.

One or more output devices 928 may also be connected to the interface circuit 924. The output devices 928 may be, comprise, or be implemented by display devices (e.g., a liquid crystal display (LCD), a light-emitting diode (LED) display, or cathode ray tube (CRT) display), printers, and/or speakers, among other examples. The controller 910 may also communicate with one or more mass storage devices 930 and/or a removable storage medium 934, such as may be or include floppy disk drives, hard drive disks, compact disk (CD) drives, digital versatile disk (DVD) drives, and/or USB and/or other flash drives, among other examples.

The coded instructions 932 may be stored in the mass storage device 930, the main memory 917, the local memory 914, and/or the removable storage medium 934. Thus, the controller 910 may be implemented in accordance with hardware (perhaps implemented in one or more chips including an integrated circuit, such as an ASIC), or may be implemented as software or firmware for execution by the processor 912. In the case of firmware or software, the implementation may be provided as a computer program product including a non-transitory, computer-readable medium or storage structure embodying computer program code (i.e., software or firmware) thereon for execution by the processor 912.

The coded instructions 932 may include program instructions or computer program code that, when executed by the processor 912, may cause the wellsite system 100, including the tool string 200 to perform methods, processes, and/or routines described herein. For example, the controller 910 may receive, process, and record the operational set-points entered by the human operator and the signals generated by the sensors 259, 422, 818. Based on the received operational set-points and the signals generated by the sensors 259, 422, 818, the controller 910 may send signals or information to the various actuators 244, 258, 266 and/or other portions of the tool string 200 and/or the tensioning device 113 to automatically perform and/or undergo one or more operations or routines described herein or otherwise within the scope of the present disclosure.

Figure 15:
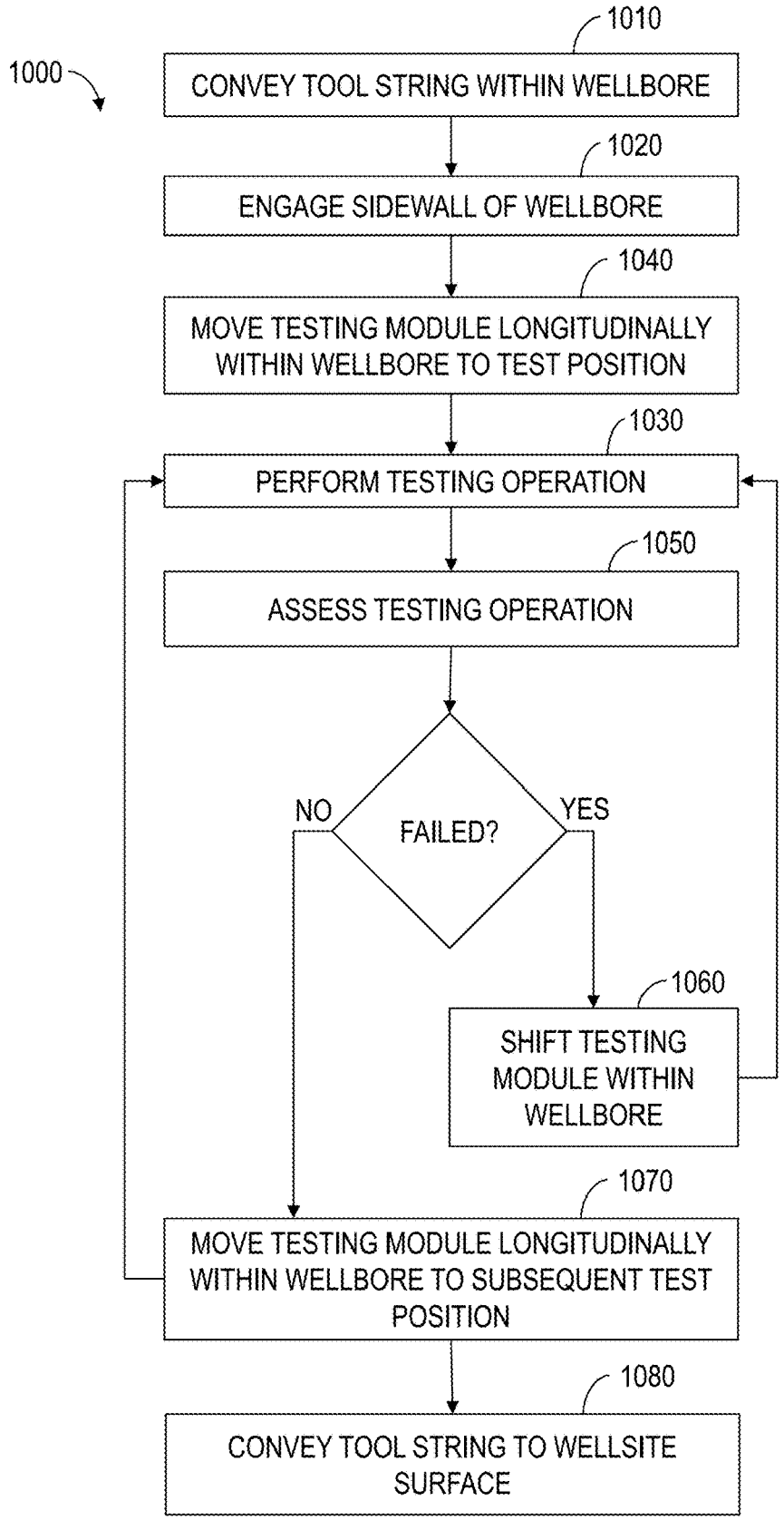
FIG. 15 is a flow-chart diagram of at least a portion of an example implementation of a method according to one or more aspects of the present disclosure.

FIG. 15 is a flow-chart diagram of at least a portion of an example implementation of a method (1000) according to one or more aspects of the present disclosure. The method (1000) may be performed utilizing or otherwise in conjunction with at least a portion of one or more implementations of one or more instances of the apparatus shown in one or more of FIGS. 1-14 and/or otherwise within the scope of the present disclosure. The method (1000) may be performed manually by the human operator and/or performed or caused, at least partially, by the controller 910 executing the coded instructions 932 according to one or more aspects of the present disclosure. Thus, the following description of the method (1000) also refers to apparatus shown in one or more of FIGS. 1-14. However, the method (1000) may also be performed in conjunction with implementations of apparatus other than those depicted in FIGS. 1-14 that are also within the scope of the present disclosure.

The method (1000) may include performing downhole testing operations at predetermined locations distributed longitudinally along the wellbore 102. Such method (1000) may include correlating the tool string 200 and tie-in depth, and operating the tensioning device 113 to convey (1010) the tool string 200 to a stop position within the wellbore 102. The stop position may be such that the sample retrieving portion 262 of the testing module 260 is located between about 7.62 centimeters (3.0 inches) and about 76.2 centimeters (30.0 inches) or more (e.g., up to about the full stroke length of the linear actuator 250) above a target or test position at which a downhole sample is to be extracted. Thereafter, the method (1000) may include operating the anchor module 240 to engage (1020) the gripping members 242 with the sidewall 103 of the wellbore 102 to maintain at least a portion of the downhole tool string 200 fixed within the wellbore 102. Once the anchor module 240 is engaged with the sidewall 103, the testing module 260 may be operated to perform (1030) the testing operations, which may include extending the anchoring member 264 against the sidewall 103 and engaging the sample retrieving portion 262 with the sidewall 103 at the test position along the wellbore 102.

Before and/or after performing (1030) the testing operations, the moving module 150, such as the linear actuator 250 or the tractor 610, 710, may be operated to move (1040) the testing module 260 longitudinally along the wellbore 102 to the test position. If the moving module 150 is the tractor 610, 710, the tractor 610, 710 may be operated to engage (1020) the sidewall 103 of the wellbore 102 to maintain the downhole tool string 200 fixed within the wellbore 102 and the anchor module 240 may be omitted from the tool string 200.

If the testing module 260 is the formation fluid testing module 310, performing (1030) the testing operations may include operating the formation fluid testing module 310 to perform the formation fluid testing operations. Such operations may include extending the anchoring member 314 and the probe assembly 312 against the sidewall 103, such that the anchoring member 314 contacts the sidewall 103 and the sealing pad 316 sealingly engages the sidewall 103. Thereafter, performing the formation fluid testing operations may include operating the pump 318 to draw the formation fluid into the testing module 260 and into the bottles 332 of the sample containment module 330.

The method (1000) may further comprise assessing (1050) the testing operations, including assessing the formation fluid testing operations. If the formation fluid testing operations have failed, such as if the formation fluid is not being received from the formation 104 or if the formation fluid is contaminated, the moving module 150, such as the linear actuator 250 or tractor 610, 710, and/or the rotary actuator 810, may be operated to move or shift (1060) the formation fluid testing module 310 to a different position along the wellbore 102. The module 310 may be shifted longitudinally in the uphole or downhole directions a distance ranging between about 7.62 centimeters (3.0 inches) and the full stroke length of the linear actuator 250 (e.g., 6.1 meters (20 feet) or more) to permit the formation fluid testing module 310 to engage the sidewall 103 at a different longitudinal position. The module 310 may also or instead be shifted azimuthally to permit the formation fluid testing module 310 to engage the sidewall 103 at a different azimuthal position. Thereafter, the formation fluid testing module 310 may be operated again to perform (1030) the formation fluid testing operations. The testing module 310 may also be shifted longitudinally and/or azimuthally, for example, if another test is intended to be performed at a close distance to the prior test, such as to capture small variations in rock or formation fluid properties.

If the testing module 260 is the formation pressure testing module 410, performing (1030) the testing operations may include operating the formation pressure testing module 410 to perform the formation pressure testing operations. Such operations may include extending the anchoring member 414 and the probe assembly 412 against the sidewall 103, such that the anchoring member 414 contacts the sidewall 103 and the sealing pad 416 sealingly engages the sidewall 103. Thereafter, performing the formation pressure testing operations may include operating the piston 426 within the chamber 424 to create a pressure drop below the formation pressure to draw the formation fluid into the formation pressure testing module 410.

The method (1000) may further comprise assessing (1050) the testing operations, including assessing the formation pressure testing operations. Assessing the formation pressure testing operations may include monitoring pressure of the formation fluid within the formation pressure testing module 410, as described above. If the monitored pressure indicates that the fluid seas is dry or tight, if the pressure test has failed, or if the fluid seal between the probe assembly 412 and the sidewall 103 has failed, the moving module 150, such as the linear actuator 250 or tractor 610, 710, and/or the rotary actuator 810, may be operated to move or shift (1060) the formation pressure testing module 410 to a different position along the wellbore 102. The module 410 may be shifted longitudinally in the uphole or downhole directions a distance ranging between about 7.62 centimeters (3.0 inches) and the full stroke length of the linear actuator 250 to permit the formation pressure testing module 310 to engage the sidewall 103 at a different longitudinal position. The module 410 may also or instead be shifted azimuthally to permit the module 410 to engage the sidewall 103 at a different azimuthal position. Thereafter, the formation pressure testing module 410 may be operated again to perform (1030) the formation pressure testing operations.

If the testing module 260 is the coring module 510, performing (1030) the testing operations may include operating the coring module 510 to perform the formation coring operations. Such operations may include extending the anchoring member 518 against the sidewall 103, operating the actuation mechanism 516 to rotate the coring bit 514, and extending the coring bit 514 against the sidewall 103 to cut a core sample from the sidewall 103. The coring operations may further include retracting the coring bit 514 from the sidewall 103 into the coring module 510 while retaining the core sample within the coring bit 514 and moving the core sample into the core sample containment module 530.

The method (1000) may further comprise assessing (1050) the testing operations, including assessing the formation coring operations. If the coring operations have failed, such as if the core sample was not retrieved from the sidewall 103 by the coring bit 514 or if the core sample is broken or otherwise damaged, the moving module 150, such as the linear actuator 250 or tractor 610, 710, and/or the rotary actuator 810, may be operated to move or shift (1060) the coring module 510 to a different position along the wellbore 102. The coring module 510 may be shifted longitudinally in the uphole or downhole directions a distance ranging between about 7.62 centimeters (3.0 inches) and the full stroke length of the linear actuator 250 to permit the coring module 510 to engage the sidewall 103 at a different longitudinal position. The coring module 510 may also or instead be shifted azimuthally to permit the coring module 510 to engage the sidewall 103 at a different azimuthal position. Thereafter, the coring module 510 may be operated again to perform (1030) the coring operations.

Once the testing operations (1030), which may include the formation fluid testing operations, the formation pressure testing operations, and the coring operations, are successfully performed, the method (1000) may further include operating the moving module 150, such as the linear actuator 250 or the tractor 610, 710, to move (1070) the testing module 260 longitudinally along the wellbore 102 to a subsequent test position along the wellbore 102.

If the moving module 150 is the tractor 610, 710, the tractor 610, 710 may be operated to move (1070) the tool string 200 longitudinally along the wellbore 102, while periodically stopping and maintaining the tool string 200 along the wellbore 102 such that the testing module 260 is located at subsequent test positions at which the downhole sample is to be extracted. The testing operations (1030), the quality assessing operations (1050), and the moving operations (1070) may be repeated until the moving module 150 has reached the final test position. Once the testing operations (1030) at the final test position are complete, the tensioning device 113 may be operated again to convey (1080) the tool string 200 to the wellsite surface 106.

If the moving module 150 is the linear actuator 250, the linear actuator 250 may be operated until the linear actuator 250 has reached end of stroke. Thereafter, the anchor module 240 may be operated to disengage the tool string 200 from the sidewall 103 and the tensioning device 113 may be operated again to convey (1070) the tool string 200 to a subsequent test position within the wellbore 102. The testing operations (1030), the quality assessing operations (1050), and the moving operations (1070) may be repeated until the final test position has been reached. Once the testing operations (1030) at the final test position are complete, the anchor module 240 may be operated to disengage the tool string 200 from the sidewall 103 and the tensioning device 113 may be operated again to convey (1080) the tool string 200 to the wellsite surface 106.

In view of the entirety of the present disclosure, including the figures and the claims, a person having ordinary skill in the art will readily recognize that the present disclosure introduces an apparatus comprising a downhole tool string for conveying within a wellbore, wherein the downhole tool string comprises: an anchor device operable to maintain at least a portion of the downhole tool string in a predetermined position within the wellbore; a testing device operable to receive a downhole sample; and a linear actuator connected between the anchor device and testing device and operable to move the testing device along the wellbore with respect to the anchor device.

The testing device may comprise a formation fluid sampling device, and the downhole sample may comprise a formation fluid sample.

The testing device may comprise a formation pressure testing device, and the downhole sample may comprise a formation fluid sample.

The testing device may comprise a formation coring device, and the downhole sample may comprise a rock formation sample.

The testing device may comprise an extendable probe for operably engaging a sidewall of the wellbore to obtain the downhole sample.

The linear actuator may be or comprise a stroker tool.

The linear actuator may comprise: a static portion directly or indirectly connected with the anchor device; a movable portion directly or indirectly connected with the testing device; and a shaft movably connected with the static portion and fixedly connected with the movable portion.

The anchor device may be a first anchor device, and the apparatus may comprise a second anchor device. The first and second anchor devices and the linear actuator may form at least a portion of a downhole tractor.

The tool string may comprise a rotary actuator connected between the linear actuator and the testing device. The rotary actuator may be operable to azimuthally rotate the testing device within the wellbore.

The apparatus may comprise a controller comprising a processor and a memory storing computer program code. The controller may be in signal communication with and operable to control the anchor device, the linear actuator, the testing device, and/or combinations thereof.

The apparatus may comprise a conveyance device at a wellsite surface from which the wellbore extends. The conveyance device may be operable to convey the tool string within a wellbore via a conveyance means.

The downhole tool string may comprise an imaging tool operable for obtaining an image of a portion of a subterranean formation surrounding the wellbore.

The present disclosure also introduces a method comprising: conveying a downhole tool string within a wellbore from a wellsite surface, wherein the downhole tool string comprises an anchor device, an linear actuator, and a testing device; engaging the anchor device with a sidewall of the wellbore to maintain at least a portion of the downhole tool string in a predetermined position within the wellbore; operating the linear actuator to move the testing device a distance longitudinally along the wellbore; and operating the testing device to receive a downhole sample.

The distance may be a first distance, and the method mat comprise, after the anchor device engagement, the linear actuator operation, and the testing device operation: further operating the linear actuator to move the testing device a second distance longitudinally along the wellbore; and then further operating the testing device to receive another downhole sample. In such implementations, among others within the scope of the present disclosure, the earlier testing device operation may comprise extending a portion of the testing device to engage the sidewall of the wellbore, and the method may comprise: before further operating the linear actuator to move the testing device the second distance longitudinally along the wellbore, retracting the portion of the testing device to disengage the sidewall of the wellbore; and after further operating the linear actuator to move the testing device the second distance longitudinally along the wellbore, extending the portion of the testing device to engage the sidewall of the wellbore.

The distance may be a first distance, and operating the testing device may further comprise extending a portion of the testing device to engage the sidewall of the wellbore, and assessing the engagement between the portion of the testing device and the sidewall of the wellbore. If the engagement is assessed as failed, the method may comprise: further operating the linear actuator to move the testing device a second distance longitudinally along the wellbore; and then further operating the testing device to receive the downhole sample.

The testing device may comprise a formation fluid sampling device, and operating the formation fluid sampling device may comprise receiving formation fluid into the formation fluid sampling device. For example, the formation fluid sampling device may comprise a probe, and operating the formation fluid sampling device may comprise extending the probe to engage the sidewall of the wellbore.

The testing device may be a formation pressure testing device comprising a probe, and operating the formation pressure testing device may comprise: extending the probe to sealingly engage the sidewall of the wellbore; receiving formation fluid via the probe; and measuring the pressure of the received formation fluid. In such implementations, among others within the scope of the present disclosure, the distance may be a first distance, and operating the formation pressure testing device may comprise assessing the sealed engagement of the probe with the sidewall of the wellbore. If the sealed engagement has failed, the method may comprise: retracting the probe to disengage the sidewall of the wellbore; further operating the linear actuator to move the testing device a second distance longitudinally along the wellbore; extending the probe to sealingly engage the sidewall of the wellbore; receiving the formation fluid via the probe; and measuring the pressure of the received formation fluid.

The testing device may comprise a formation coring device comprising a coring bit, and operating the coring device may comprise: extending the coring bit into the sidewall of the wellbore to cut a formation sample; and retracting the coring bit containing the formation sample into the formation coring device. In such implementations, among others within the scope of the present disclosure, the distance may be a first distance, and the method may comprise, after extending the coring bit into the sidewall of the wellbore and retracting the coring bit: further operating the linear actuator to move the testing device a second distance longitudinally along the wellbore; extending the coring bit into the sidewall of the wellbore to cut another formation sample; and retracting the coring bit containing the another formation sample into the formation coring device.

The linear actuator may comprise a stroker tool.

The linear actuator may comprise: a static portion directly or indirectly connected with the anchor device; a movable portion directly or indirectly connected with the testing device; and a shaft movably connected with the static portion and fixedly connected with the movable portion, and extending the linear actuator may comprise extending the shaft with respect to the static portion to move the movable portion and the testing device.

The anchor device may be a first anchor device, and the downhole tool string may further comprise a second anchor device. The first and second anchor devices and the linear actuator may collectively form at least a portion of a downhole tractor.

The downhole tool string may comprise a rotary actuator, and the method may comprise, after operating the testing device: azimuthally moving the testing device along the wellbore; and then operating the testing device to receive a downhole sample.

The present disclosure also introduces a method comprising: operating a conveyance device at a wellsite surface to convey a downhole tool string within a wellbore, wherein the downhole tool string comprises a moving device and a testing device; engaging a sidewall of the wellbore to maintain at least a portion of the downhole tool string fixed within the wellbore; operating the moving device to move the testing device longitudinally to a position along the wellbore; and operating the testing device to engage a portion of the testing device with the sidewall at the position along the wellbore.

The position may be a first position, and the method may comprise, after operating the testing device: operating the moving device to move the testing device longitudinally to a second position along the wellbore; and operating the testing device to engage the portion of the testing device with the sidewall at the second position along the wellbore. In such implementations, the method may comprise, after operating the moving device to move the testing device longitudinally to the second position along the wellbore: operating the moving device to move the testing device longitudinally to a third position along the wellbore; and operating the testing device to engage the portion of the testing device with the sidewall at the third position along the wellbore. The method may comprise: before operating the moving device to move the testing device longitudinally to the second position along the wellbore, operating the testing device to disengage the portion of the testing device from the sidewall of the wellbore; and after operating the moving device to move the testing device longitudinally to the second position along the wellbore, operating the testing device to engage the portion of the testing device with the sidewall of the wellbore.

The downhole tool string may comprise a hydraulic power supply, and the method may comprise operating the hydraulic power supply to engage the sidewall and operate the moving device.

Operating the testing device may comprise assessing the engagement of the portion of the testing device with the sidewall. If the engagement has failed, the method may comprise: operating the testing device to disengage the portion of the testing device with the sidewall; operating the moving device to move the testing device a distance along the wellbore; and operating the testing device to engage the portion of the testing device with the sidewall.

The testing device may comprise a formation fluid sampling device, the portion of the testing device may be or comprise a probe, and operating the formation fluid sampling device may comprise receiving formation fluid into the formation fluid sampling device via the probe.

The testing device may be a formation pressure testing device, the portion of the testing device may be or comprise a probe, and operating the formation pressure testing device may comprise: sealingly engaging the probe with the sidewall of the wellbore; receiving formation fluid via the probe; and measuring the pressure of the received formation fluid. In such implementations, among others within the scope of the present disclosure, operating the formation pressure testing device may comprise assessing the sealed engagement of the probe with the sidewall of the wellbore. If the sealed engagement has failed, the method may comprise: retracting the probe to disengage the probe from the sidewall of the wellbore; operating the moving device to move the testing device a distance longitudinally along the wellbore; extending the probe to sealingly engage the probe with the sidewall of the wellbore; receiving the formation fluid via the probe; and measuring the pressure of the received formation fluid.

The testing device may comprise a formation coring device comprising a coring bit, and operating the coring device may comprise: extending the coring bit into the sidewall of the wellbore to cut a formation sample; and retracting the coring bit containing the formation sample into the formation coring device. In such implementations, among others within the scope of the present disclosure, the position may be a first position, and the method may comprise, after extending the coring bit into the sidewall of the wellbore and retracting the coring bit: operating the moving device to longitudinally move the formation coring device to a second position along the wellbore; extending the coring bit into the sidewall of the wellbore to cut another formation sample; and retracting the coring bit containing the another formation sample into the formation coring device.

The moving device may be or comprise a stroker tool.

The downhole tool string may further comprise an anchor tool, and engaging the sidewall of the wellbore to maintain at least the portion of the downhole tool string fixed within the wellbore may be performed by the anchor tool.

The moving device may be or comprise a downhole tractor, and engaging the sidewall of the wellbore to maintain at least the portion of the downhole tool string fixed within the wellbore may be performed by the downhole tractor.

The position may be a first position, the tool string may further comprise a rotary actuator, and the method may comprise azimuthally moving the testing device to a second position along the wellbore.

The present disclosure also introduces a method comprising: (A) conveying a downhole tool string within a wellbore from a wellsite surface, wherein the downhole tool string comprises: (1) an anchor device; (2) a linear actuator and/or a rotary actuator; and (3) a testing device; (B) engaging the anchor device with a sidewall of the wellbore to maintain at least a portion of the downhole tool string in a predetermined position within the wellbore; (C) operating the linear actuator and/or the rotary actuator to longitudinally and/or azimuthally move the testing device to an intended position relative to the wellbore; and (D) performing a fluid testing, pressure testing, or coring operation utilizing the testing device at the intended position.

The downhole tool string may comprise the linear actuator and the rotary actuator, and operating the linear actuator and/or the rotary actuator may comprise operating the linear actuator and the rotary actuator to longitudinally and azimuthally move the testing device to the intended position.

The intended position may be a first intended position, the fluid testing, pressure testing, or coring operation may be a first fluid testing, pressure testing, or coring operation, and the method may further comprise, after performing the first fluid testing, pressure testing, or coring operation utilizing the testing device at the first intended position: further operating the linear actuator and/or the rotary actuator to longitudinally and/or azimuthally move the testing device to a second intended position relative to the wellbore; and then performing a second fluid testing, pressure testing, or coring operation utilizing the testing device at the second intended position. Performing the first fluid testing, pressure testing, or coring operation utilizing the testing device at the first intended position may comprise extending a portion of the testing device to engage the sidewall of the wellbore, and the method may further comprise: before operating the linear actuator and/or the rotary actuator to move the testing device to the second intended position, retracting the portion of the testing device to disengage the sidewall of the wellbore; and after operating the linear actuator and/or the rotary actuator to move the testing device to the second intended position, extending the portion of the testing device to again engage the sidewall of the wellbore.

The intended position may be a first position, and performing the fluid testing, pressure testing, or coring operation utilizing the testing device at the first position may comprise: (A) extending a portion of the testing device to engage the sidewall of the wellbore; (B) determining that the engagement has failed; then (C) further operating the linear actuator and/or the rotary actuator to move the testing device to a second position relative to the wellbore; and then (D) performing the fluid testing, pressure testing, or coring operation utilizing the testing device at the second position.

The wellbore may extend into a subterranean formation comprising formation fluid, the testing device may comprise a formation pressure testing device comprising a probe, and performing the fluid testing, pressure testing, or coring operation may comprise: establishing fluid communication between the testing device and the subterranean formation by extending the probe to sealingly engage the wellbore sidewall; and measuring pressure of the formation fluid via the fluid communication established with the testing device at the intended position.

The wellbore may extend into a subterranean formation comprising formation fluid, the testing device may comprise a formation fluid sampling device comprising a probe, and performing the fluid testing, pressure testing, or coring operation may comprise: establishing fluid communication between the testing device and the subterranean formation by extending the probe to sealingly engage the wellbore sidewall; and receiving the formation fluid into the formation fluid sampling device via the extended probe engaged with the wellbore sidewall. The intended position may be a first position, and performing the fluid testing, pressure testing, or coring operation may further comprise: (A) determining that the sealed engagement has failed; (B) retracting the probe from the sidewall of the wellbore; (C) operating the linear actuator and/or the rotary actuator to move the testing device to a second position relative to the wellbore; and then (D) while the testing device is in the second position: (1) reestablishing fluid communication between the subterranean formation and the testing device by again extending the probe to sealingly engage the wellbore sidewall; and (2) receiving the formation fluid into the formation fluid sampling device via the extended probe engaged with the wellbore sidewall.

The wellbore may extend into a subterranean formation, the testing device may comprise a coring device having a coring bit, and performing the fluid testing, pressure testing, or coring operation may comprise: extending the coring bit into the wellbore sidewall to cut a core sample from the subterranean formation; and retracting the coring bit containing the core sample into the coring device. The intended position may be a first position, and the method may further comprise: (A) operating the linear actuator and/or the rotary actuator to move the testing device to a second position relative to the wellbore; and (B) while the testing device is in the second intended position: (1) extending the coring bit into the wellbore sidewall to cut an additional core sample; and (2) retracting the coring bit containing the additional core sample into the coring device.

The downhole tool string may comprise an imaging device, the method may further comprise operating the imaging device to obtain an image of a portion of a subterranean formation surrounding the wellbore, the image may dimensionally correspond with a longitudinal range of the linear actuator and/or an azimuthal range of the rotary actuator, and operating the linear actuator and/or the rotary actuator to longitudinally and/or azimuthally move the testing device to the intended position may be based on the obtained image.

The foregoing outlines features of several embodiments so that a person having ordinary skill in the art may better understand the aspects of the present disclosure. A person having ordinary skill in the art should appreciate that they may readily use the present disclosure as a basis for designing or modifying other processes and structures for carrying out the same purposes and/or achieving the same advantages of the embodiments introduced herein. A person having ordinary skill in the art should also realize that such equivalent constructions do not depart from the scope of the present disclosure, and that they may make various changes, substitutions and alterations herein without departing from the spirit and scope of the present disclosure.

The Abstract at the end of this disclosure is provided to comply with 37 C.F.R. § 1.72(b) to permit the reader to quickly ascertain the nature of the technical disclosure. It is submitted with the understanding that it will not be used to interpret or limit the scope or meaning of the claims.

What is claimed is:

1. An apparatus comprising:

a downhole tool string for conveying within a wellbore, wherein the downhole tool string comprises:

an anchor device operable to maintain a portion of the downhole tool string in a predetermined position within the wellbore;

a testing device operable to receive a downhole sample;

a linear actuator connected between the anchor device and testing device and operable to move the testing device along the wellbore with respect to the anchor device; and a rotary actuator configured to azimuthally rotate the testing device within the wellbore, wherein the rotary actuator comprises a static portion that couples to the linear actuator, a rotary portion coupled to the testing device, and one or more sensors comprising an encoder, a resolver, a rotary potentiometer, a synchro, or any combination thereof.

2. The apparatus of claim 1, wherein the testing device comprises a formation fluid sampling device, and wherein the downhole sample comprises a formation fluid sample.

3. The apparatus of claim 1, wherein the testing device comprises a formation pressure testing device, and wherein the downhole sample comprises a formation fluid sample.

4. The apparatus of claim 1, wherein the testing device comprises a formation coring device, and wherein the downhole sample comprises a rock formation sample.

5. The apparatus of claim 1, wherein the testing device comprises an extendable probe for operably engaging a sidewall of the wellbore to obtain the downhole sample.

6. The apparatus of claim 1, wherein the anchor device is a first anchor device, wherein the apparatus further comprises a second anchor device, and wherein the first and second anchor devices and the linear actuator form at least a portion of a downhole tractor.

7. The apparatus of claim 1, further comprising a controller comprising a processor and a memory storing computer program code, wherein the controller is in signal communication with and operable to control the anchor device, the linear actuator, and the testing device.

8. The apparatus of claim 1, wherein the downhole tool string further comprises an imaging tool operable for obtaining an image of a portion of a subterranean formation surrounding the wellbore.

9. A method comprising:

conveying a downhole tool string within a wellbore from a wellsite surface, wherein the downhole tool string comprises:

an anchor device;

a linear actuator;

a testing device; and a rotary actuator comprising a static portion, a rotary portion, and one or more sensors comprising an encoder, a resolver, a rotary potentiometer, a synchro, or any combination thereof, wherein the rotary actuator is configured to couple the static portion to the linear actuator and the rotary portion to the testing device; and engaging the anchor device with a sidewall of the wellbore to maintain at least a portion of the downhole tool string in a predetermined position within the wellbore;

operating the linear actuator to longitudinally move the testing device to an intended position relative to the wellbore;

operating the rotary actuator to azimuthally move the testing device to the intended position relative to the wellbore; and performing a fluid testing, pressure testing, or coring operation utilizing the testing device at the intended position.

10. The method of claim 9, wherein operating the linear actuator and/or the rotary actuator comprises operating the linear actuator and the rotary actuator to longitudinally and azimuthally move the testing device to the intended position.

11. The method of claim 9, wherein:

the intended position is a first intended position;

the fluid testing, pressure testing, or coring operation is a first fluid testing, pressure testing, or coring operation; and the method further comprises, after performing the first fluid testing, pressure testing, or coring operation utilizing the testing device at the first intended position:

further operating the linear actuator and/or the rotary actuator to longitudinally and/or azimuthally move the testing device to a second intended position relative to the wellbore; and then performing a second fluid testing, pressure testing, or coring operation utilizing the testing device at the second intended position.

12. The method of claim 11, wherein performing the first fluid testing, pressure testing, or coring operation utilizing the testing device at the first intended position comprises extending a portion of the testing device to engage the sidewall of the wellbore, and wherein the method further comprises:

before operating the linear actuator and/or the rotary actuator to move the testing device to the second intended position, retracting the portion of the testing device to disengage the sidewall of the wellbore; and after operating the linear actuator and/or the rotary actuator to move the testing device to the second intended position, extending the portion of the testing device to again engage the sidewall of the wellbore.

13. The method of claim 9, wherein the intended position is a first position, and wherein performing the fluid testing, pressure testing, or coring operation utilizing the testing device at the first position comprises:

extending a portion of the testing device to engage the sidewall of the wellbore;

determining that the engagement has failed; then further operating the linear actuator and/or the rotary actuator to move the testing device to a second position relative to the wellbore; and then performing the fluid testing, pressure testing, or coring operation utilizing the testing device at the second position.

14. The method of claim 9, wherein:

the wellbore extends into a subterranean formation comprising formation fluid;

the testing device comprises a formation pressure testing device comprising a probe; and performing the fluid testing, pressure testing, or coring operation comprises:

establishing fluid communication between the testing device and the subterranean formation by extending the probe to sealingly engage the sidewall of the wellbore; and measuring pressure of the formation fluid via the fluid communication established with the testing device at the intended position.

15. The method of claim 9, wherein:

the wellbore extends into a subterranean formation comprising formation fluid;

the testing device comprises a formation fluid sampling device comprising a probe; and performing the fluid testing, pressure testing, or coring operation comprises:

establishing fluid communication between the testing device and the subterranean formation by extending the probe to sealingly engage the sidewall of the wellbore; and receiving the formation fluid into the formation fluid sampling device via the extended probe engaged with the sidewall of the wellbore.

16. The method of claim 15, wherein the intended position is a first position, and wherein performing the fluid testing, pressure testing, or coring operation further comprises:

determining that the sealed engagement has failed;

retracting the probe from the sidewall of the wellbore;

operating the linear actuator and/or the rotary actuator to move the testing device to a second position relative to the wellbore; and then while the testing device is in the second position:

reestablishing fluid communication between the subterranean formation and the testing device by again extending the probe to sealingly engage the sidewall of the wellbore; and receiving the formation fluid into the formation fluid sampling device via the extended probe engaged with the sidewall of the wellbore.

17. The method of claim 9, wherein:

the wellbore extends into a subterranean formation;

the testing device comprises a coring device having a coring bit; and performing the fluid testing, pressure testing, or coring operation comprises:

extending the coring bit into the sidewall of the wellbore to cut a core sample from the subterranean formation; and retracting the coring bit containing the core sample into the coring device.

18. The method of claim 17, wherein the intended position is a first position, and wherein the method further comprises:

operating the linear actuator and/or the rotary actuator to move the testing device to a second position relative to the wellbore; and while the testing device is in the second intended position:

extending the coring bit into the sidewall of the wellbore to cut an additional core sample; and retracting the coring bit containing the additional core sample into the coring device.

19. The method of claim 9, wherein the downhole tool string comprises an imaging device; and wherein the method further comprises:

operating the imaging device to obtain an image of a portion of a subterranean formation surrounding the wellbore, wherein the image dimensionally corresponds with a longitudinal range of the linear actuator and/or an azimuthal range of the rotary actuator; and operating the linear actuator and/or the rotary actuator to longitudinally and/or azimuthally move the testing device to the intended position is based on the obtained image.

* * * * *